US009393610B2

(12) United States Patent
Butcher et al.

(10) Patent No.: US 9,393,610 B2
(45) Date of Patent: Jul. 19, 2016

(54) CONVERSION PRESS

(71) Applicant: Stolle Machinery Company, LLC, Centennial, CO (US)

(72) Inventors: Gregory H. Butcher, Columbus, OH (US); Aaron E. Carstens, Centerville, OH (US); Patrick K. McCarty, Dayton, OH (US); Jason A. Davidson, Sidney, OH (US); Neil A. Zumberger, Sidney, OH (US); Kenneth E. Carper, Cincinnati, OH (US); Russell Bauer, West Chester, OH (US)

(73) Assignee: Stolle Machinery Company, LLC, Centennial, CO (US)

( * ) Notice: Subject to any disclaimer, the term of this patent is extended or adjusted under 35 U.S.C. 154(b) by 260 days.

(21) Appl. No.: 14/211,534

(22) Filed: Mar. 14, 2014

(65) Prior Publication Data

US 2014/0271044 A1 Sep. 18, 2014

Related U.S. Application Data

(60) Provisional application No. 61/792,363, filed on Mar. 15, 2013.

(51) Int. Cl.

| | |
|---|---|
| ***B21D 51/38*** | (2006.01) |
| *B21D 51/44* | (2006.01) |
| *B21D 51/26* | (2006.01) |

(52) U.S. Cl.

CPC ..... *B21D 51/38* (2013.01); *B21D 51/383* (2013.01); *B21D 51/26* (2013.01); *B21D 51/44* (2013.01)

(58) Field of Classification Search

CPC ..... B21D 51/38; B21D 51/383; B21D 22/28; B21D 22/30; B21D 51/44; B21D 51/46; B21D 51/26

See application file for complete search history.

(56) References Cited

U.S. PATENT DOCUMENTS

| | | | | |
|---|---|---|---|---|
| 4,079,668 | A * | 3/1978 | Gailus | B30B 15/281 100/208 |
| 4,106,422 | A | 8/1978 | Buhrke | |
| 4,382,737 | A | 5/1983 | Jensen et al. | |
| 4,723,882 | A | 2/1988 | Wissman et al. | |
| 4,854,799 | A | 8/1989 | Herdzina et al. | |
| 5,182,934 | A | 2/1993 | Herdzina et al. | |
| 5,209,098 | A | 5/1993 | Cudzik | |
| 7,063,492 | B1 * | 6/2006 | Artrip | B21D 51/383 413/12 |
| 7,234,907 | B1 | 6/2007 | Artrip | |
| 7,464,576 | B2 | 12/2008 | Turner et al. | |
| 2008/0267736 | A1 | 10/2008 | Artrip | |

OTHER PUBLICATIONS

Stolle Machinery Company, LLC, PCT/US2014/028626 International Search Report, Aug. 28, 2014, 4 pages.

* cited by examiner

*Primary Examiner* — Alexander P Taousakis
*Assistant Examiner* — Mohammad I Yusuf
(74) *Attorney, Agent, or Firm* — Eckert Seamans Cherin & Mellott, LLC; David C. Jenkins

(57) ABSTRACT

A conversion press wherein a crankshaft drives the motion of the tooling assemblies within a number of lanes is provided. The crankshaft is structured to move the tooling assemblies associated with less than the total number of lanes. That is, for example, a four lane conversion press could include two crankshafts each actuating the tooling assemblies of two lanes. In an exemplary embodiment, each lane has a single associated crankshaft.

18 Claims, 19 Drawing Sheets

CONVERSION PRESS

CROSS REFERENCE TO RELATED APPLICATION

This application is a traditional application of and claims priority to U.S. Provisional Patent Application Ser. No. 61/790,363, filed Mar. 15, 2013, entitled CONVERSION SYSTEM.

BACKGROUND OF THE INVENTION

1. Field of the Invention

The disclosed and claimed concept relates to a conversion system and, more specifically, to a multi-out conversion system utilizing a crankshaft associated with each end lane or tab, wherein the lanes are isolated portions of the total load thereby reducing and aligning the applied load per crankshaft.

2. Background Information

Metallic containers (e.g., cans) for holding products such as, for example, food and beverages, are typically provided with an easy open can end on which a pull tab is attached (e.g., without limitation, riveted) to a tear strip or severable panel. The severable panel is defined by a scoreline in the exterior surface (e.g., public side) of the can end. The pull tab is structured to be lifted and/or pulled to sever the scoreline and deflect and/or remove the severable panel, thereby creating an opening for dispensing the contents of the can.

A can end consists of a shell and tab. The shell and the tab are made in separate presses. The shell is created by cutting out and forming the shell from a coil of sheet metal product (e.g., without limitation, sheet aluminum; sheet steel). In a separate press, tabs for the can end are produced by feeding in a continuous coil through a tab die. The shells and tabs are conveyed to a conversion press. At the conversion press, the blank shell is fed onto a belt which indexes through an elongated, progressive die known as a lane die. The lane dies include a number of tooling stations which form the paneling, score and integrated rivet on the shell. The lane dies are part of an upper tooling assembly and a lower tooling assembly. The tabs move longitudinally through the die(s). The longitudinal axes of the tab die(s) are disposed generally perpendicular to the longitudinal axes of the lane dies. At the final tool station, the tab is coupled to the shell thereby creating the can end.

Typically, each tool station of the conversion press includes an upper tool member, which is structured to be advanced towards a lower tool member upon actuation of a press ram. The shell is received between the upper and lower tool members. Alternatively stated, the shell is received between the upper and lower tool assemblies. The upper tool assembly is structured to reciprocate between an upper position, spaced from the lower tool assembly, and a lower position, adjacent the lower tool assembly. Thus, the upper tool member engages the shell when the upper tool assembly is in the second position and the upper and/or lower tool members, respectively, act upon the public and/or product (e.g., interior side, which faces the can body) sides of the shell, in order to perform a number of the aforementioned conversion operations. Upon completion of a cycle, the press ram retracts the upper tool assembly and the partially converted shell is moved to the next successive tool station, or the tooling is changed within the same station, to perform the next conversion operation.

As noted above, the conversion press is, typically, structured to process multiple can ends at one time. That is, the conversion press includes multiple lane dies defining separate "lanes." Each lane includes successive tool stations. It is common to include an even number of lanes, e.g., four lanes. The successive tool stations in each lane may be identical or different. Generally, the first tool station in each lane performs a forming operation such as forming a bubble, or, first formation to create the integrated rivet. This operation requires a high force, but the location of the application of force is furthest away from ram resulting in the highest tipping moment.

The conversion press typically includes a single elongated ram that operates all die sets. The ram applies a total superposition of force(s) of about 80 tons. Rams capable of providing such forces are large and require a large drive assembly as well. This force is applied along the longitudinal axis of the ram. The ram is typically coupled to a central location on a die shoe that supports the upper tool members. Thus, when there are four lanes, the ram is attached between the two central lanes and offset from all tool stations. In this configuration, the ram, the die shoe and the linkages therebetween are subjected to multiple loads and moment arms that are unbalanced. That is, because the ram is not aligned with any single lane, there are various tipping moments (i.e. torque) applied to the ram, the die shoe and the linkages therebetween that would not be present, or would be lower, if the conversion press had a single lane and the press ram was aligned with the lane.

The forces on the ram, the die shoe and the linkages therebetween are further unbalanced because the bubble operation at the first tool station creates a greater tipping moment than subsequent tool stations. That is, while the bubble operation may not need the greatest force, because this operation occurs at the first tool station, the distance from the center of the tool lane die is greater than for other tool stations. Thus, the distance multiplied by a large force creates the largest tipping moment. The tab lane die, however, is subjected to lesser forces and, as such, the loads and tipping moments cause fewer problems with regard to the tab lane die assembly. The tab lane, however, does create tipping moments on the ram when the ram actuates the tab lane die. That is, by virtue of being coupled, and spaced, from the ram, the ram and other elements are subject to wear and tear due to the tab lane die assembly even though the tab lane die assembly is relatively unaffected by those same forces. The large force required to operate the conversion press, as well as the unbalanced load, cause these elements to deflect, thereby causing wear and tear on the ram, the end lane die assemblies, including the die shoe, and the linkages therebetween.

Further, the ram is, typically, disposed above the die shoe and tooling stations. Generally, it is easier to construct a ram assembly above the tooling elements than to provide space for the ram below the tooling elements. Thus, the ram is, typically, disposed above the can ends being formed. In this configuration, lubricants and cooling fluids used in/on the ram may drip on the can lids.

A specific example is disclosed in Appendix A wherein, as shown in Figure A, a conversion press includes three lanes, lanes A, B, and C. Each end lane typically includes eight tooling stations and each tab lane typically includes seventeen tooling stations. As shown in the table data at page 1, the loads in the first three stations is greater than the other stations. Using the lane A stake station as an initial origin, the tipping moments for each lane and station can be determined. These calculations are shown on Appendix pages 2-6. For example, because lane B is disposed along the X-axis, there are no X moment arms for the lane A tool stations. Further, the ram center is disposed at the location indicated. Knowing the various loads and moment arms relative to the initial origin, the loads and moment arms relative to the ram center can be determined as shown on Appendix A, page 7. Because these loads are not balanced, the ram press includes "kiss blocks" disposed at locations spaced from the ram center (three identified). When the kiss blocks are deflected, they create a counter force that balances the ram forces. That is, opposing kiss blocks are disposed on the upper tool assembly and the lower tool assembly. Generally, the kiss blocks contact each other as the upper tool assembly moves into the second position and level the tooling stations.

That is, a kiss block is disposed between each die shoe and each upper and lower tool member. A kiss block is made of hardened steel. A kiss block is disposed at a tool station where the final product specification must be held within 0.0001 inch. As an upper tooling element comes down, the kiss blocks engage and are deflected by as much as 0.025". That is, the upper tooling assembly and the lower tooling assembly have, at the second position, a minimum spacing. Just before the upper tooling assembly and the lower tooling assembly reach the minimum spacing, the kiss blocks engage each other. The distance the upper tooling assembly and the lower tooling assembly move between the time the kiss blocks engage each other and their second position is, as used herein, the "deflection" or "interference" of the kiss blocks. During the time of the interference, the kiss blocks are deformed not unlike a marshmallow is deformed under pressure.

The amount of deflection is set prior to forming operations. Typically, the tool assemblies are moved into the second position and the relative positions of the upper and lower tool assemblies are adjusted so that the kiss blocks are deflected. This adjustment is identified as "pre-load." The pre-load deflection of kiss blocks in different locations are not always the same. For example, when the unload side (downstream, finished product side) kiss blocks are pre-loaded with a 0.025 inch deflection, the load side (upstream, unfinished side) kiss blocks are between about 0.009 inch and 0.011 inch, or about 0.010 inch deflection. The deflection of the kiss blocks removes substantially all deflection out of the ram and also takes up any linkage/bearing clearances in the press. In this configuration, the kiss blocks ensure that the upper tooling is substantially flat and parallel to the bottom tooling. It also ensures that the residual of any end stock between the upper and lower tooling, such as a score, is maintained to as accurate as +/−0.00045 inch (i.e. a 0.0009 inch range). When the die assemblies separate, the kiss blocks vibrate while returning to their original shape. This vibration, known as "snap through," causes wear and tear on the conversion press. The snap through vibration is increased when the deflection is greater.

The unbalanced forces, and the associated wear and tear, the size of the ram and associated drive, and the potential for fluids dripping on the can ends are problems with known presses. The degree to which the kiss blocks are deflected, i.e. the amount of deflection of the kiss blocks, is also a disadvantage.

SUMMARY OF THE INVENTION

At least one embodiment of the disclosed and claimed concept provides for a multi-out conversion press wherein a crankshaft drives the motion of the tooling assemblies within a number of lanes. In an exemplary embodiment, there are three end lanes and one tab lane. The crankshaft is structured to move the tooling assemblies associated with less than the total number of lanes of the multi-out conversion press. That is, for example, a four-lane conversion press could include two crankshafts each actuating the tooling assemblies of two lanes. In an exemplary embodiment, each end lane and each tab lane has an associated crankshaft. That is, there are three crankshafts associated with end lanes and one crankshaft associated with a tab lane. In this configuration, the associated drive, as well as the force required to drive the conversion press, is substantially less than the force required to drive a ram coupled to all lanes of the press. By reducing the forces and moments acting upon the linkage assembly and tooling assemblies, wear and tear is reduced. Further, because the smaller proportion of the total load has been aligned and reduced to each lane/crankshaft, the kiss blocks are deflected to a lesser degree; this reduces the snap through vibration discussed above.

Each crankshaft is elongated and the crankshaft longitudinal axis extends substantially parallel to the longitudinal axis of the associated end lane. In an exemplary embodiment, each end lane crankshaft is disposed substantially below a single associated end lane. In this configuration, the linkage assembly is subjected to fewer offset forces, i.e. forces that produce tipping moments on the conversion system components. Further, in this configuration, wear and tear on the linkage assembly and tooling assemblies is reduced. Further, as the crankshaft is disposed below the tooling assemblies, lubricants and other fluids associated with the crankshaft and drive cannot drip onto the can ends.

The crankshaft associated with the tab lane is disposed generally perpendicular to the longitudinal axis of the tab lane. The crankshaft associated with the tab lane is also disposed generally below the tab lane thereby reducing contamination from lubricants and other fluids associated with the crankshaft. The tab lane kiss blocks are not subjected to interference during a forming operation. That is, there is a gap between the tab lane kiss blocks and other elements of the tab lane tooling assemblies. Further, because the tab lane is separate from the end lanes, forces in the tab lane have no effect on the end lane die assemblies. That is, by separating the tab lane die assemblies from the end lane die assemblies, wear and tear is reduced.

Accordingly, the disclosed and claimed concept provides a can end conversion system including a plurality of elongated sets of lanes, each lane set including a crankshaft, a linkage assembly, a first tooling assembly, and a second tooling assembly. The can end conversion system further includes a multiple press drive assembly that is operatively coupled to each crankshaft. Each crankshaft includes an elongated body. Each crankshaft body longitudinal axis is substantially parallel to a lane set longitudinal axis. Each linkage assembly is rotatably coupled to the crankshaft. Each linkage assembly is coupled to the first tooling assembly. Each second tooling assembly disposed in a substantially fixed position relative to the crankshaft. Thus, rotation of each crankshaft moves the first tooling assembly between a first position, wherein the first tooling assembly is spaced from the second tooling assembly, and a second position, wherein the first tooling assembly is adjacent the second tooling assembly. When shells and tabs are passed through the conversion press, forming operations occur when the first tooling assembly is moving into the second position.

BRIEF DESCRIPTION OF THE DRAWINGS

A full understanding of the invention can be gained from the following description of the preferred embodiments when read in conjunction with the accompanying drawings in which:

FIG. 15A is a top plan view, FIG. 15B is a front view and FIG. 15C is a side view.

DESCRIPTION OF THE PREFERRED EMBODIMENTS

Figure 1:
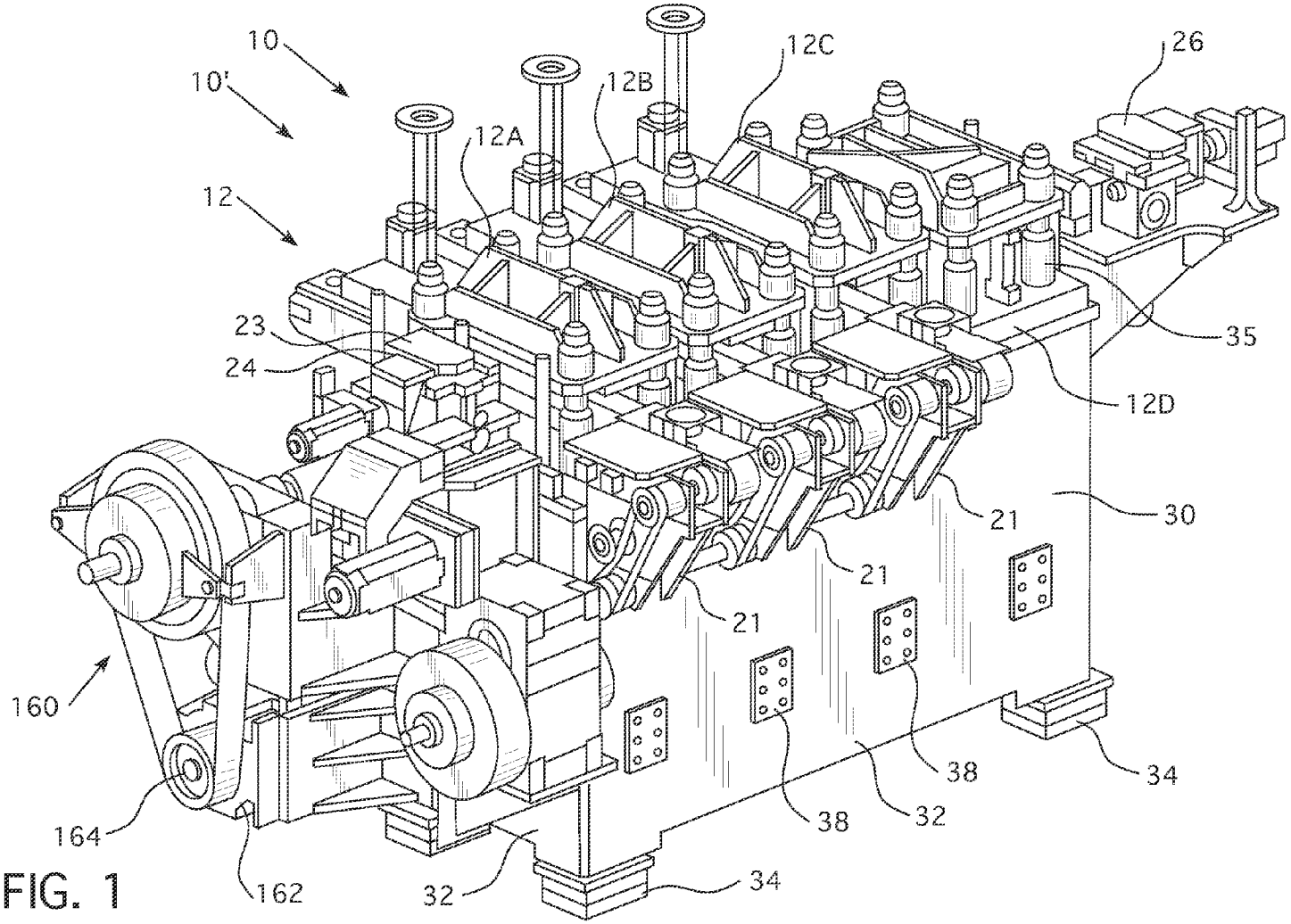
FIG. 1 is an isometric view of a can end conversion system.

For purposes of illustration, embodiments of the disclosed concept will be described as applied to can ends for beverage/beer cans, although it will become apparent that they could also be employed to other containers such as, for example and without limitation, cans for liquids other than beer and beverages, and food cans.

It will be appreciated that the specific elements illustrated in the figures herein and described in the following specification are simply exemplary embodiments of the disclosed concept, which are provided as non-limiting examples solely for the purpose of illustration. Therefore, specific dimensions, orientations and other physical characteristics related to the embodiments disclosed herein are not to be considered limiting on the scope of the disclosed concept.

Directional phrases used herein, such as, for example, clockwise, counterclockwise, left, right, top, bottom, upwards, downwards and derivatives thereof, relate to the orientation of the elements shown in the drawings and are not limiting upon the claims unless expressly recited therein.

As employed herein, the terms "can" and "container" are used substantially interchangeably to refer to any known or suitable container, which is structured to contain a substance (e.g., without limitation, liquid; food; any other suitable substance), and expressly includes, but is not limited to, food cans, as well as beverage cans, such as beer and soda cans.

As employed herein, the term "can end" refers to the lid or closure that is structured to be coupled to a can, in order to seal the can.

As used herein, a "multi-out" conversion press is a conversion press wherein there is more than one lane of shells being coupled to tabs during a cycle.

As used herein, the singular form of "a," "an," and "the" include plural references unless the context clearly dictates otherwise.

As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. As used herein, "fixedly coupled" or "fixed" means that two components are coupled so as to move as one while maintaining a constant orientation relative to each other.

As used herein, the statement that two or more parts or components "engage" one another shall mean that the parts exert a force against one another either directly or through one or more intermediate parts or components.

As used herein, the word "unitary" means a component is created as a single piece or unit. That is, a component that includes pieces that are created separately and then coupled together as a unit is not a "unitary" component or body.

As used herein, the term "number" shall mean one or an integer greater than one (i.e., a plurality).

As used herein, a "coupling assembly" includes two or more couplings or coupling components. The components of a coupling or coupling assembly are generally not part of the same element or other component. As such the components of a "coupling assembly" may not be described at the same time in the following description.

As used herein, a "coupling" is one element of a coupling assembly. That is, a coupling assembly includes at least two components, or coupling components, that are structured to be coupled together. It is understood that the elements of a coupling assembly are compatible with each other. For example, in a coupling assembly, if one coupling element is a snap socket, the other coupling element is a snap plug.

As used herein, "correspond" indicates that two structural components are sized and shaped to be similar to each other and may be coupled with a minimum amount of friction. Thus, an opening which "corresponds" to a member is sized slightly larger than the member so that the member may pass through the opening with a minimum amount of friction. This definition is modified if the two components are said to fit "snugly" together or "snuggly correspond," in that situation, the difference between the size of the components is even smaller whereby the amount of friction increases. This definition is further modified if the two components are said to "substantially correspond." "Substantially correspond" means that the size of the opening is very close to the size of the element inserted therein. That is, not so close as to cause substantial friction, as with a snug fit, but with more contact and friction than a "corresponding fit," i.e. a "slightly larger" fit.

As used herein, "structured to [verb]" means that the identified element or assembly has a structure that is shaped, sized, disposed, coupled and/or configured to perform the identified verb. For example, a member that is "structured to move" is movably coupled to another element and includes elements that cause the member to move or the member is otherwise configured to move in response to other elements or assemblies.

A can end conversion system 10, and more specifically a beverage and food can end conversion system 10', is shown in FIGS. 1-5. Generally, the conversion system 10 forms a can end 1 from a can end shell 1' and a tab 2. Specifically, in the container industry, a pre-converted can end 1 is commonly referred to as a can end shell 1', or simply a shell 1'. One such shell 1' is shown on a feeder device 21 (both shown schematically). As defined herein, the terms "can end," "can end shell" and "shell" may be used interchangeably. Further, as detailed below, a tab 2 is formed and coupled to each shell 1'.

A conversion system 10, that is utilized to perform the conversion operations is partially shown in FIGS. 1-5. The conversion system 10 does not include a ram press. As used herein, a "ram press" is a ram that is either guided by slides or hydrostatic pistons. In one embodiment, such a "ram press" generates a compressive load of about 250,000 lbs., but, as is known, the necessary load or tonnage to form the metal of the can end is a function of the mass of the ram and the velocity of the slide/pistons. Further, the conversion system 10 does not include a "ram press," as is conventionally known in the art such as, but not limited to a press manufactured by Minster of Ohio or Bruderer of Switzerland, and shown in FIGS. 15A-15C. That is, as used herein, a "ram press" consists of a base upon which two columns are mounted. On top of the two columns is a cross member housing known as a crown. The crown is an assembly of a ram and the necessary linkage, typically a crank, which drives the ram up and down.

The conversion system 10 includes a plurality of press units 12. As shown, there are four press units 12A, 12B, 12C, 12D. As detailed below, the four press units 12A, 12B, 12C, 12D define three end lanes 20A, 20B, 20C (described below), which are identified as end presses 12A, 12B, 12C, and one tab lane 20D (described below), which is identified as a tab press 12D. The press units 12 are modular. As used herein, "modular" means devices having substantially the same general size and shape so that one "modular" device may be replaced with another "modular" device. The press units 12 include coupling assemblies 14 structured to fix the press units 12 together. In an exemplary embodiment, the coupling assemblies 14 include linking pins 15 structured to couple one or two press units 12 to a housing assembly 30. The feeder device 21, in an exemplary embodiment, is modular as well. That is, each unit 12 includes a feeder device 21, or, for the tab press 12D, discussed below, a tab feeder assembly 23.

Figure 8:
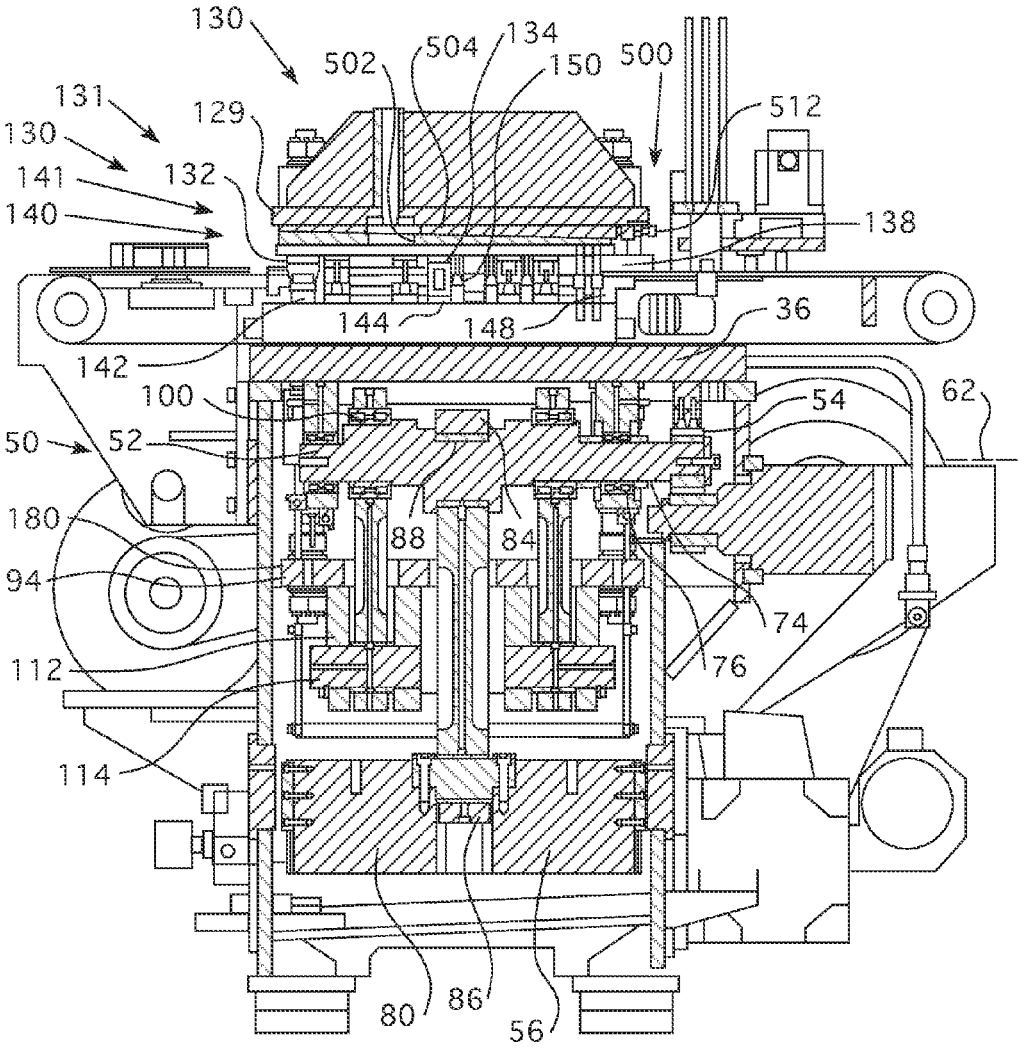
FIG. 8 is a first cross-sectional side view of an end press unit.
Figure 9:
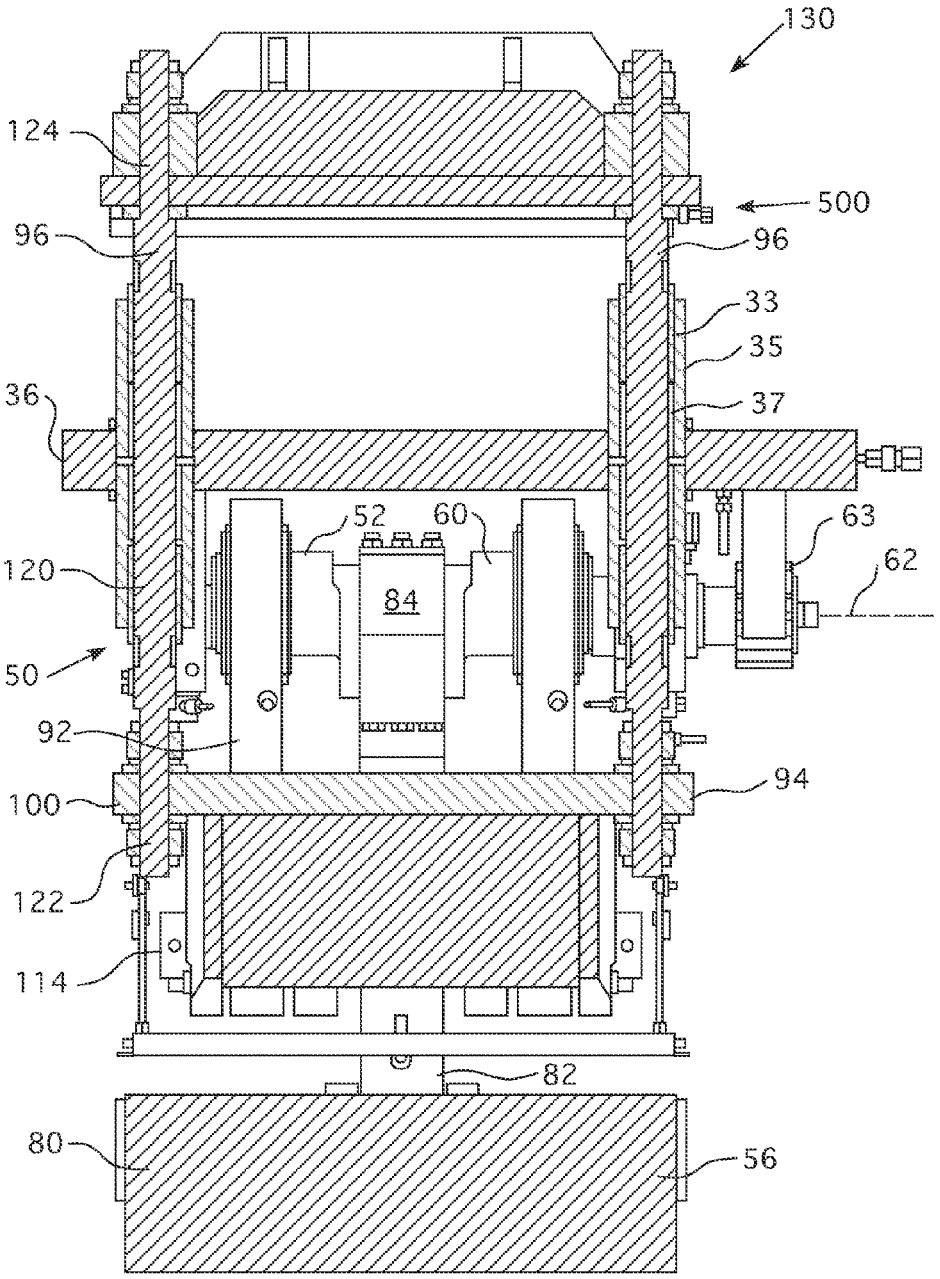
FIG. 9 is a second cross-sectional side view of an end press unit with selected tooling components removed for clarity.
Figure 10:
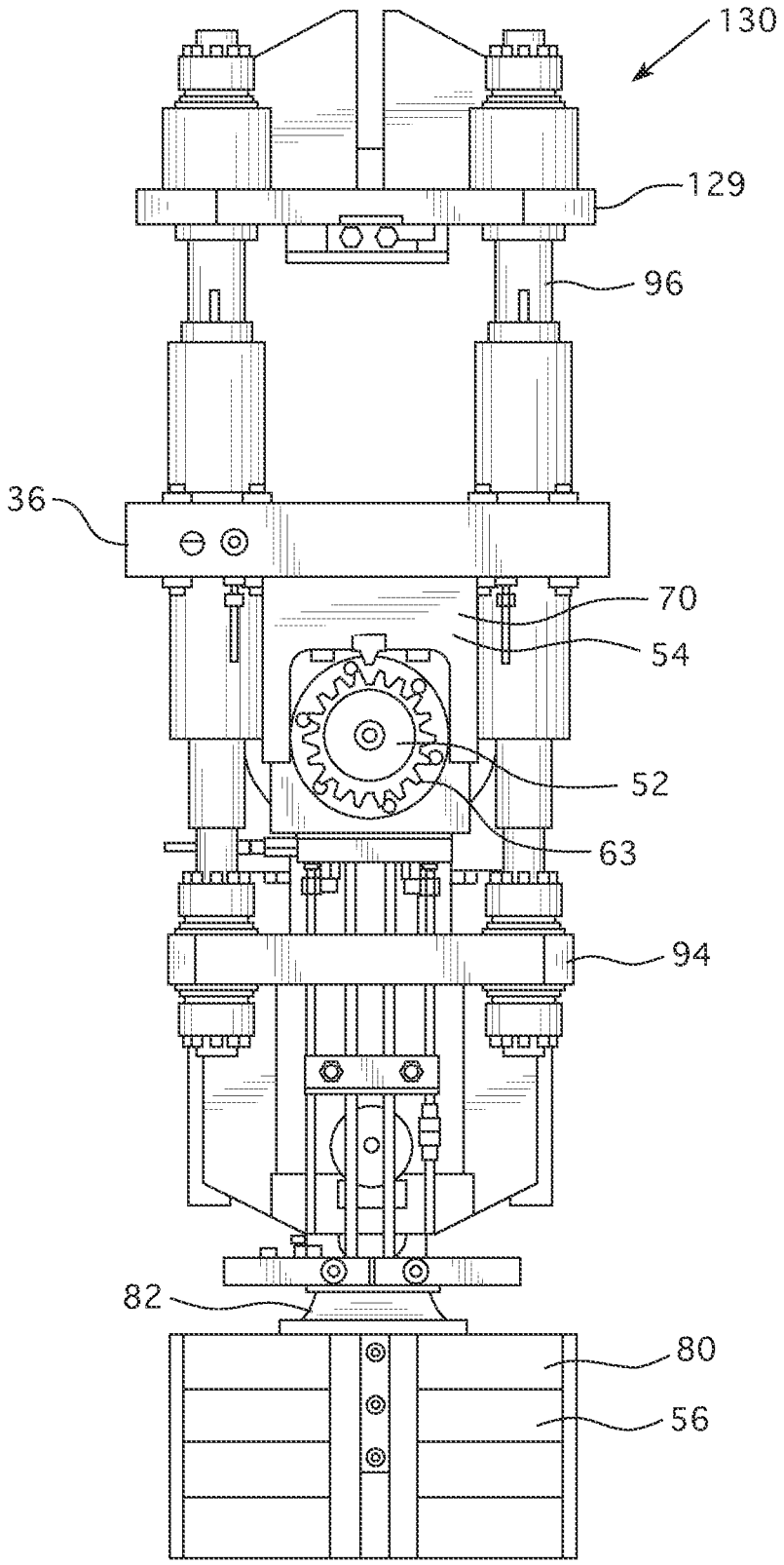
FIG. 10 is a partial end view of an end press unit with selected tooling components removed for clarity.
Figure 11:
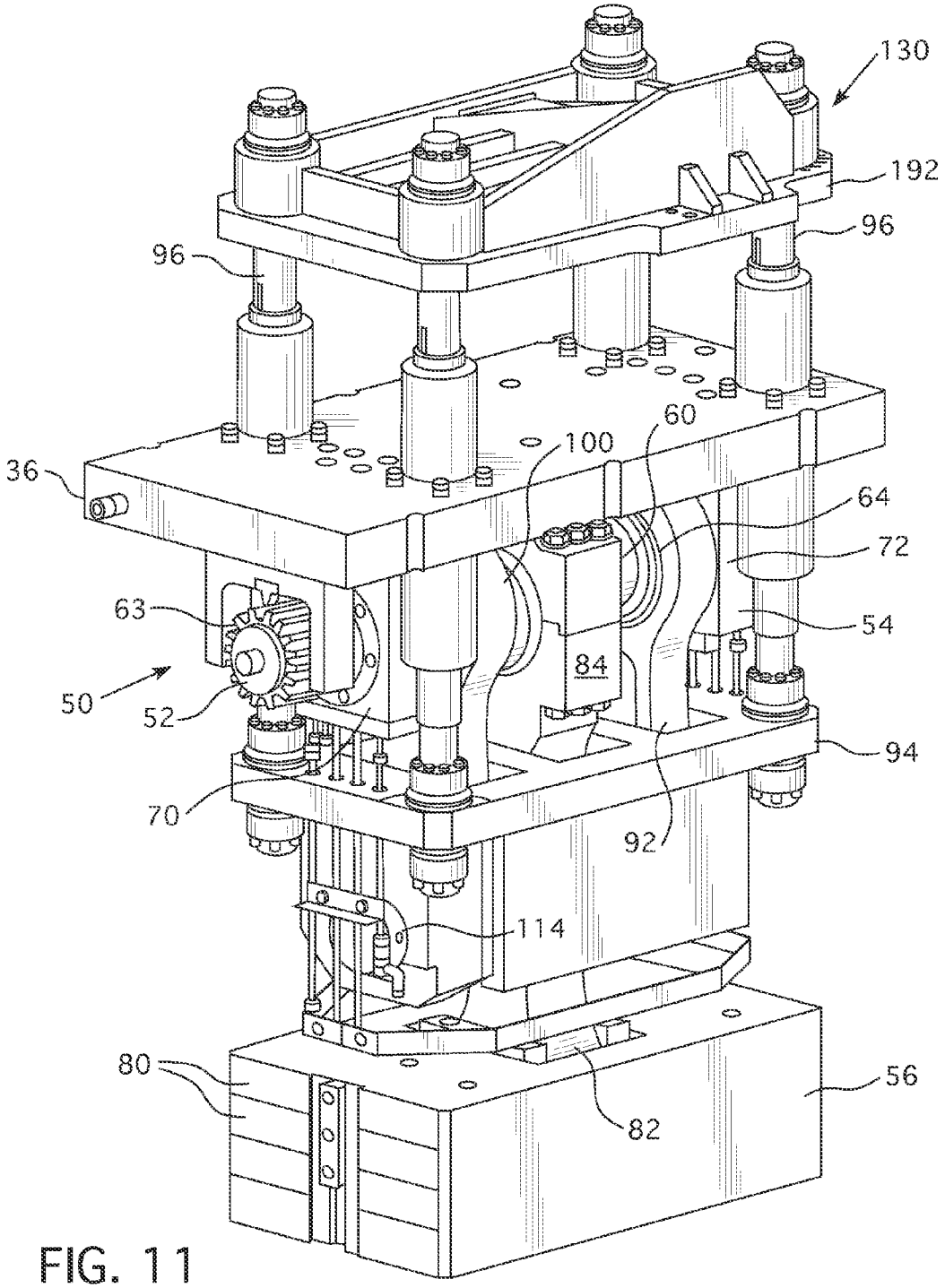
FIG. 11 is a partial isometric view of an tab press unit with selected tooling components removed for clarity.
Figure 12:
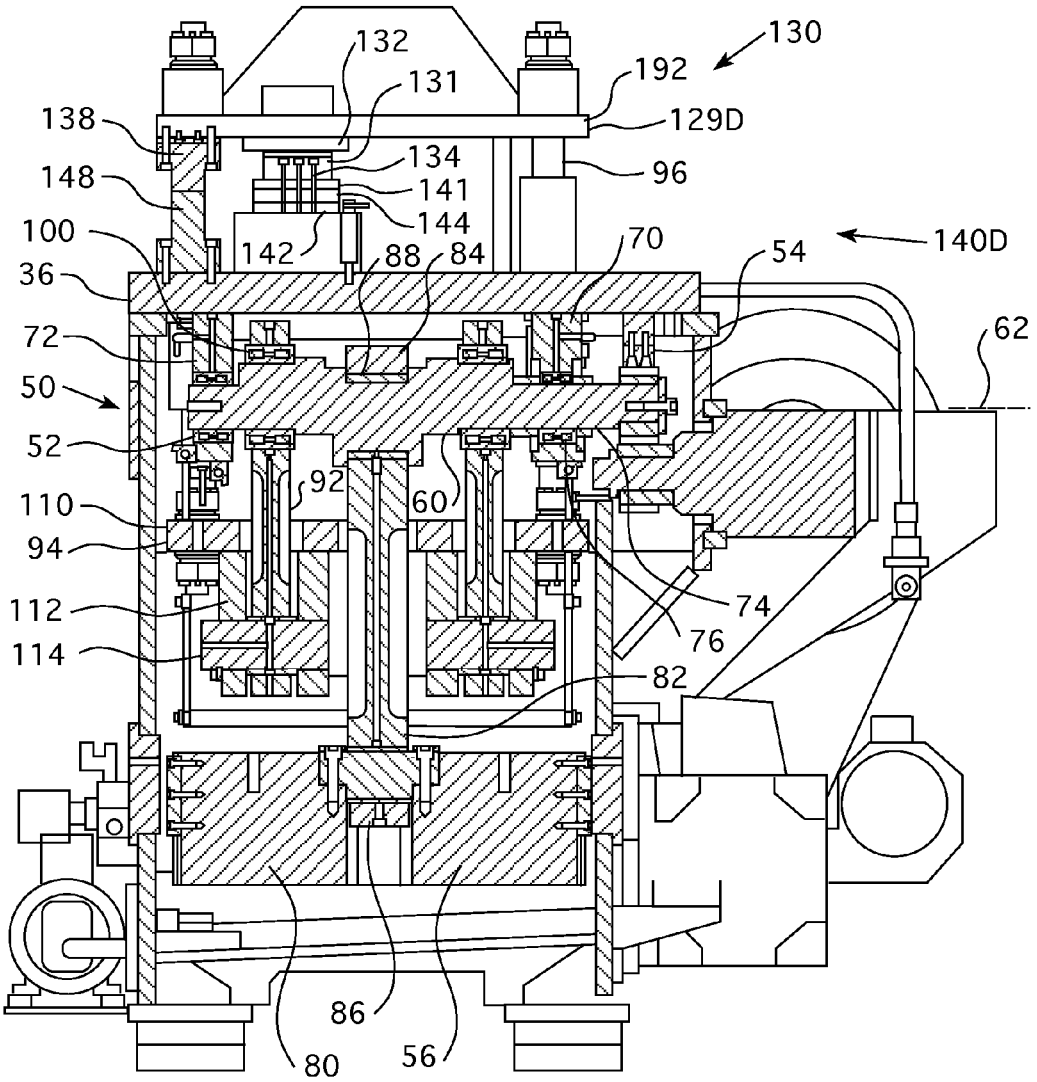
FIG. 12 is a first cross-sectional side view of a tab press unit.
Figure 13:
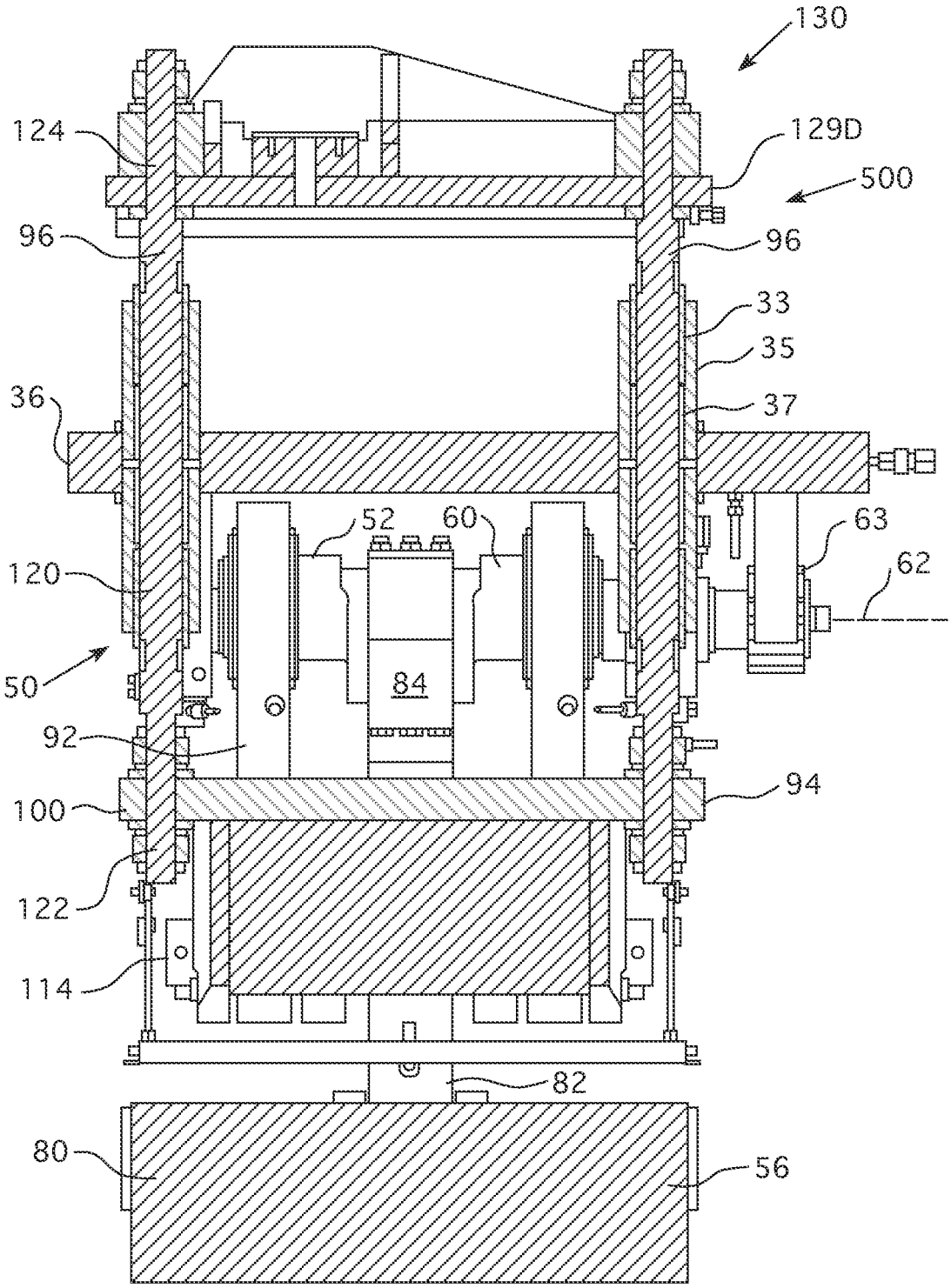
FIG. 13 is a second cross-sectional side view of a tab press unit with selected tooling components removed for clarity.
Figure 14:
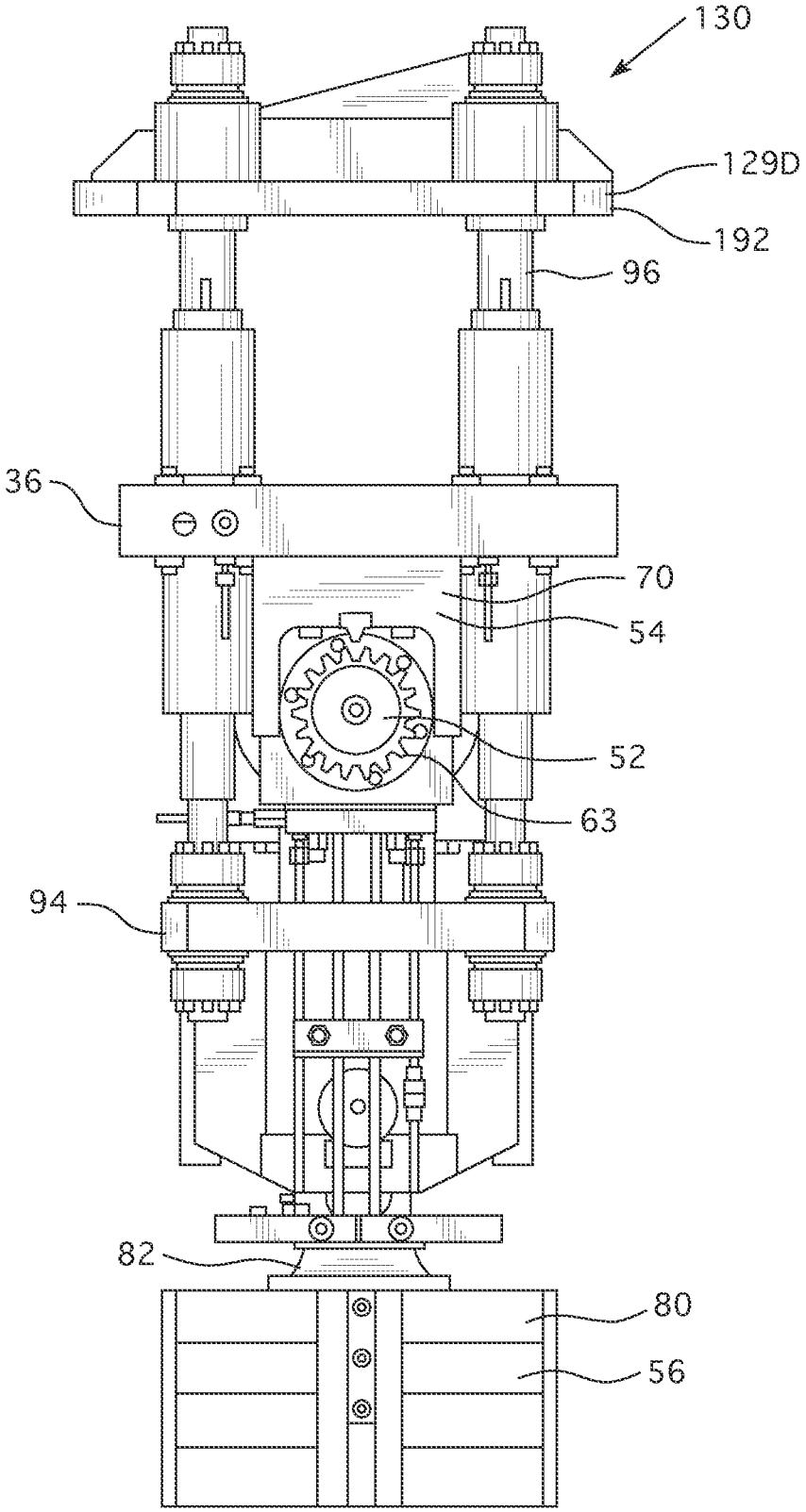
FIG. 14 is a partial end view of a tab press unit with selected tooling components removed for clarity.

The end press units 12A, 12B, 12C are substantially similar and, as such, only one press unit is described below. It is understood that each press unit 12 includes substantially similar elements. Further, with the exception of the direction of the tab lane 20D and the linkage assembly, the tab press 12D is also similar to the end press units 12A, 12B, 12C and, unless otherwise noted, includes similar elements. For reference purposes, if elements of two press units 12 need to be described, the elements of the separate press units will be identified with a letter. Further, the elements of each press unit 12 are "associated." That is, as used herein, "associated" means that the elements are part of the same press unit 12 and operate together, or, act upon/with each other in some manner. Elements external to a press unit 12 may be associated with multiple press units 12. For example, as discussed below, a multiple press drive assembly 160 is associated with a plurality of press units 12. Thus, for example, a crankshaft 52A and linkage assembly 90A, discussed below, of a first press unit 12A are "associated" and operate with each other, but are separate from the elements of a second press unit 12B. Each press unit 12 includes a number of elongated sets of lanes 20 (or lane set 20, or lane 20), a crankshaft 52 (FIGS. 6-13), a linkage assembly 90 (FIGS. 6-13), a first tooling assembly 130, and a second tooling assembly 140 (FIGS. 8 and 12, shown schematically). The lane set 20 may further be identified as an end lane 20A, 20B, or 20C, or, as a tab lane 20D. In one exemplary embodiment, not shown, each press unit 12 further includes a separate housing assembly (not shown). In an exemplary embodiment, the press units 12A, 12B, 12C, 12D are disposed in a common housing assembly 30. In an exemplary embodiment, discussed in detail below, a multiple press drive assembly 160 is associated with a plurality of press units 12.

As used herein, a "lane" is a path over which a can end shell 1' or tab 2 passes and which are generally defined by the first tooling assembly 130, and more specifically by the first lane die 131, which is disposed above the "lane," and the second tooling assembly 140, and more specifically by the second lane die 141, which is disposed below the "lane." That is, each lane set 20 includes the first and second tooling assemblies 130, 140 and other subcomponents and elements which define the path over which a shell 140 or tab 2 travel during forming operations. These elements are discussed in detail below. A "set of lanes" means that there are a number of lanes 20 defined by the same first and second tooling assemblies 130, 140. That is, in an exemplary embodiment (not shown), a single pair of first and second tooling assemblies 130, 140 include a plurality of lane dies 131, 141 and define a plurality lanes 20. In another exemplary embodiment, and the embodiment discussed hereinafter, each press unit 12 includes a single lane 20. As a lane 20 is elongated, each lane 20A, 20B, 20C, 20D (as shown) has an longitudinal axis 22A, 22B, 22C, 22D. As discussed below, the end lane longitudinal axes 22A, 22B, 22C are generally parallel with each other. The tab lane longitudinal axis 22D extends generally perpendicular to the end lane longitudinal axes 22A, 22B, 22C.

There is a feeder device 21 (FIG. 2) associated with each end lane 20A, 20B, 20C. Each feeder device 21 is structured to progressively advance, or "index," a number of work pieces, i.e., can end shells 1'. That is, as used herein, "progressively advance" or "index" means that the feeder device 21 moves a work piece forward a predetermined distance during each cycle of the press system 10, as described below, As further described below, the press system 10 includes a number of tool stations 150. In an exemplary embodiment, the feeder device 21 advances each work piece ahead by one tool station 150 during each cycle.

Further, the tab lane 20D, in an exemplary embodiment, includes a tab feeder assembly 23. The tab feeder assembly 23 includes a push tab feeder 24 and a pull tab feeder 26. The push tab feeder 24 is disposed "upstream" of the tab lane 20D, i.e. at a location before the tab feed stock enters the tab lane 20D, The pull tab feeder 26 is disposed "downstream" of the tab lane 20D, i.e. at a location after the tab feed stock leaves the tab lane 20D, Both the push tab feeder 24 and the pull tab feeder 26 are structured to advance the tab feed stock through the tab lane 20D. Further, each of the push tab feeder 24 and the pull tab feeder 26 include a servo-motor (not shown) that drive a cam indexing gearbox (not shown). The servo-motor, along with the cam indexing gearbox are structured to advance the tab feed stock, and tabs after formation thereof, in a synchronized manner. That is, the tab feed stock indexes forward along the tab lane 20D at a rate substantially similar to the rate of the shells 1' advancing through the end lanes 20A, 20B, 20C. Further, in an exemplary embodiment, a scrap chopper assembly 28 is disposed adjacent, or coupled to, the pull tab feeder 26. The scrap chopper assembly 28 is structured to chop, or otherwise shred, the remaining tab feed stock that exits the tab lane 20D. It is understood that the feeder devices 21 and tab feeder assembly 23 generally operate during the time the first tooling assembly 130 is moving from the second position to the first position, as described below.

In an exemplary embodiment, the housing assembly 30 includes a number of sidewalk 32, a number of floor mountings 34, and a number of fixed mounting plates 36. In an exemplary embodiment, the housing assembly 30 has a generally rectangular cross-section with four sidewalk 32. The sidewalk 32 may include a number of openings 38 (behind cover plates shown) that provide access to the enclosed space defined by the housing assembly 30. The floor mountings 34 are disposed at each corner of the housing assembly 30 below the sidewalk 32; the sidewalk are coupled, directly coupled, or fixed to the thereto. Each fixed mounting plate 36 is, in an exemplary embodiment, a planar member disposed in a generally horizontal plane. Each fixed mounting plate 36 is coupled, directly coupled, or fixed to the upper ends of the housing assembly sidewalk 32. It is noted that each mounting plate 36 is also considered to be part of the individual press units 12A, 12B, 12C, 12D. That is, when a press unit 12 is removed or replaced, the mounting plate 36 remains with the press unit 12. Further, each second tooling assembly 140 is, in an exemplary embodiment, coupled, directly coupled or fixed to the associated mounting plate 36. In another embodiment, not shown, the housing assembly 30 includes a number of frame members that form a frame assembly to support the various operatively coupled elements and second tooling assembly 140.

Drive assembly includes a motor having an output shaft. The motor provides a rotational motion to the output shaft. In one embodiment, not shown, output shaft is directly coupled to crankshaft 52, discussed below. In another exemplary embodiment, also not shown, drive assembly further includes a tension member, such as but not limited to, a belt, timing belt or chain. In an exemplary embodiment, not shown, drive assembly further includes a drive wheel selectively fixed to output shaft. That is, drive wheel is fixed to output shaft by a shear pin. Shear pin is structured to shear at a predetermined level of force or rotational torque. As discussed below, anti-rotational forces may be applied to crankshaft 52, during such an occurrence, and provided that the force exceeds the predetermined level of force, or rotational torque, of the shear pin shear pin will shear and break the operative coupling between output shaft and crankshaft 52. The tension member extends between output shaft and, more specifically, drive wheel, and crankshaft, to transfer rotational motion from output shaft to crankshaft 52. That is, drive assembly is "operatively coupled" to the crankshaft 52. As used herein, "operatively coupled" means that motion in one element is transferred to another element. It is noted that location of motor relative to the housing assembly 30 is selectable; for example, when multiple press units are disposed adjacent to each other and each has its own motor (not shown), each motor may, for example, be disposed in line with the lane 20.

Figure 2:
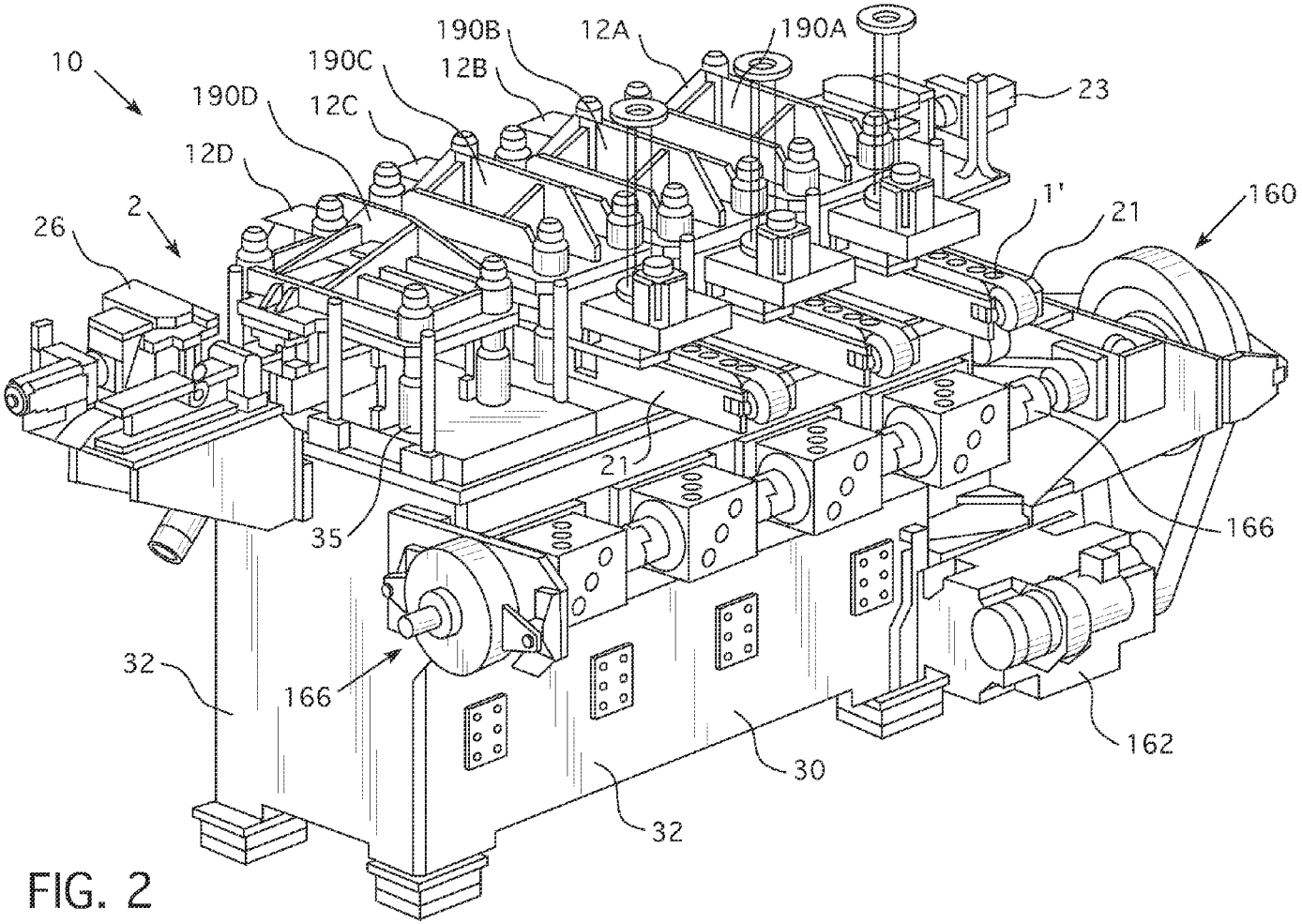
FIG. 2 is another isometric view of a can end conversion system.
Figure 3:
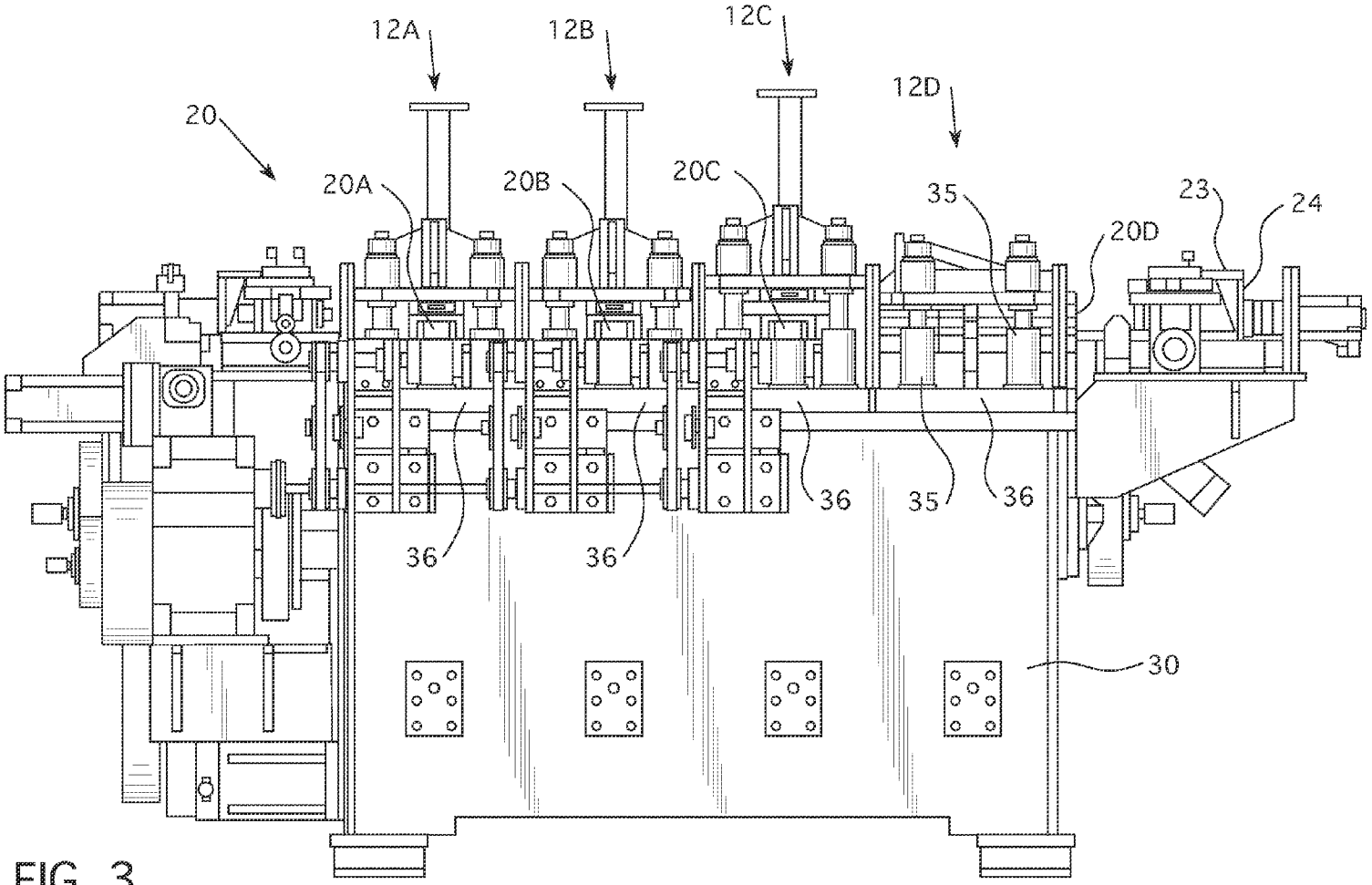
FIG. 3 is an end view of a can end conversion system.

In the exemplary embodiment shown, a multiple press drive assembly 160, shown in FIGS. 1-2, is associated with a plurality of press units 12A, 12B, 12C, 12D. That is, the multiple press drive assembly 160 includes a motor 162 with an output shaft 164, a clutch/brake assembly 300 with an output shaft 302, as well as a direct drive linkage assembly 166. The direct drive linkage assembly 166 is operatively coupled to the motor 162 via the clutch/brake assembly 300, described below. That is, the rotational motion of the motor output shaft 164 is transferred to the direct drive linkage assembly 166 and, more specifically, to the linkage shafts 170.

The direct drive linkage assembly 166 includes a number of linkage shafts 170 and gear boxes 172. There is one right angle miter gearbox 172 for each press units 12A, 12B, 12C, 12D. Each gearbox 172 includes two of the linkage shafts 170 extending from opposite sides. Each linkage shaft 170, as well as clutch assembly output shaft 302, includes a selectable coupling 174. Each selectable coupling 174 is structured to be selectably (i.e. removably) coupled to another selectable coupling 174 in a fixed relationship. As shown, the selectable couplings 174 are coupled to each other thereby coupling the linkage shafts 170 to the linkage shaft 170 of an adjacent gearbox 172, or to the clutch assembly output shaft 302. In this configuration, the linkage shafts 170 are coupled to each other and to the output shaft 164 in a fixed relationship. That is, the linkage shafts 170 and the clutch assembly output shaft 302 rotate together.

Figure 4:
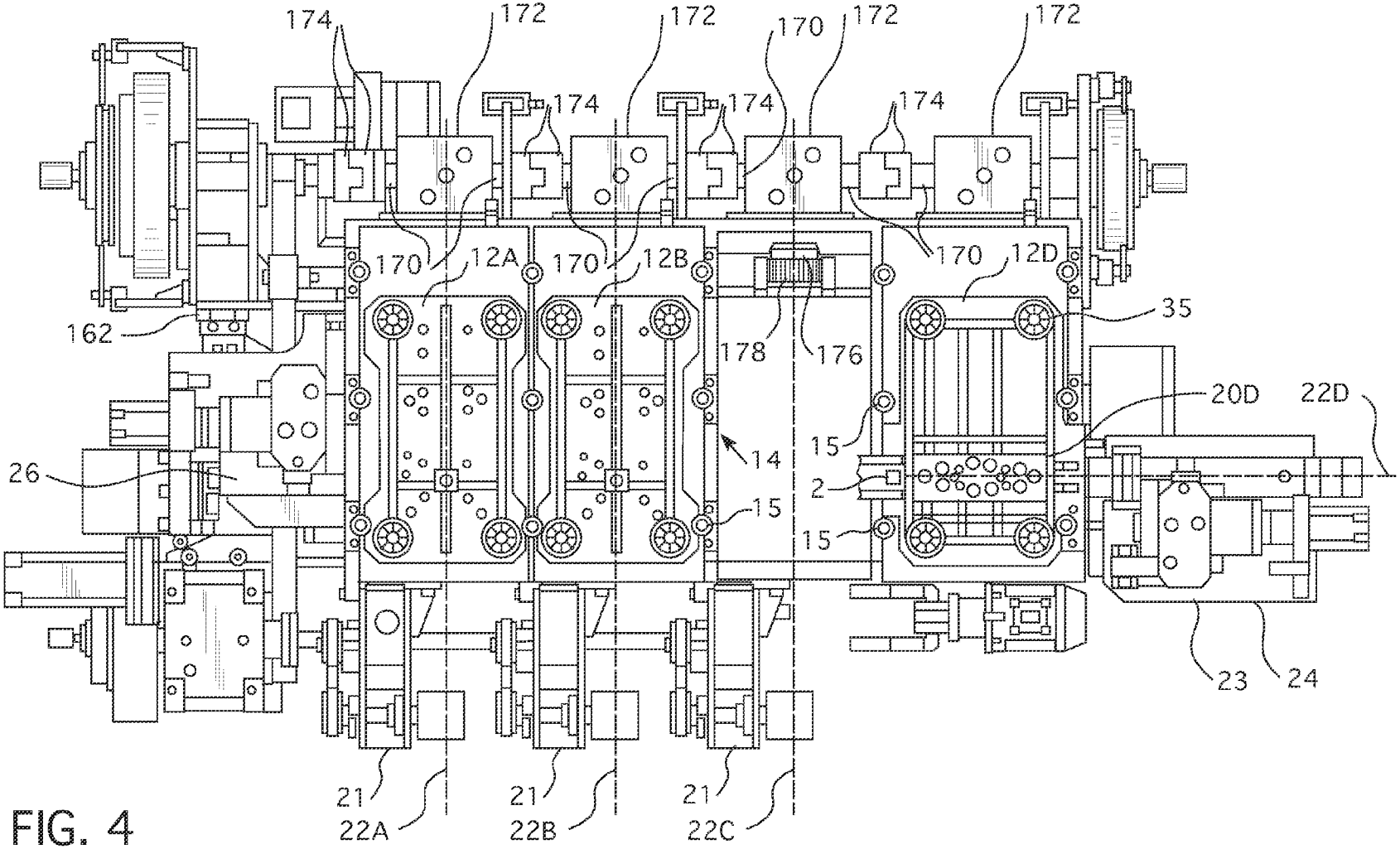
FIG. 4 is a top view of a can end conversion system with one press unit removed for clarity.
Figure 5:
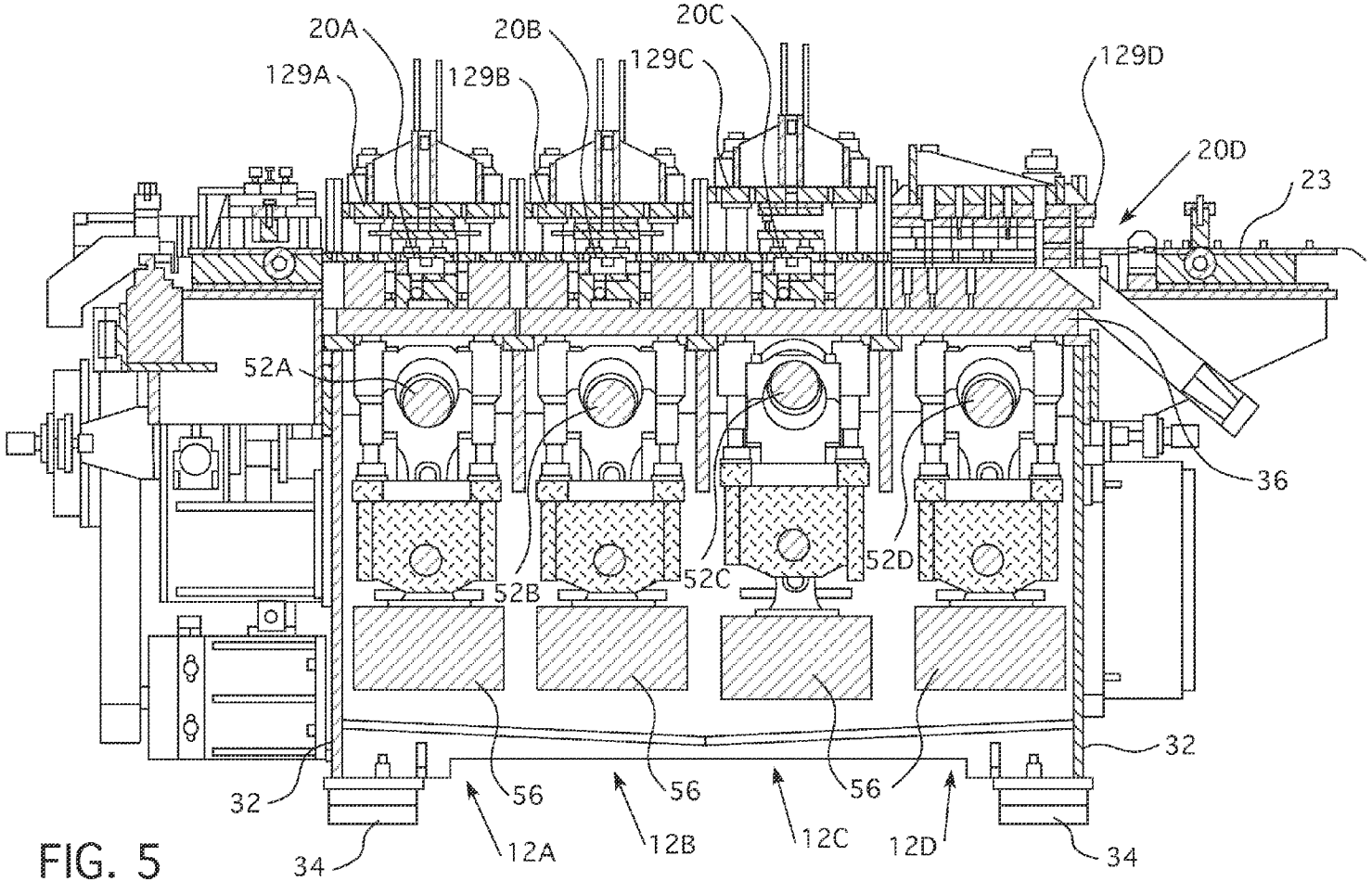
FIG. 5 is a cross-sectional view of a can end conversion system.
Figure 6:
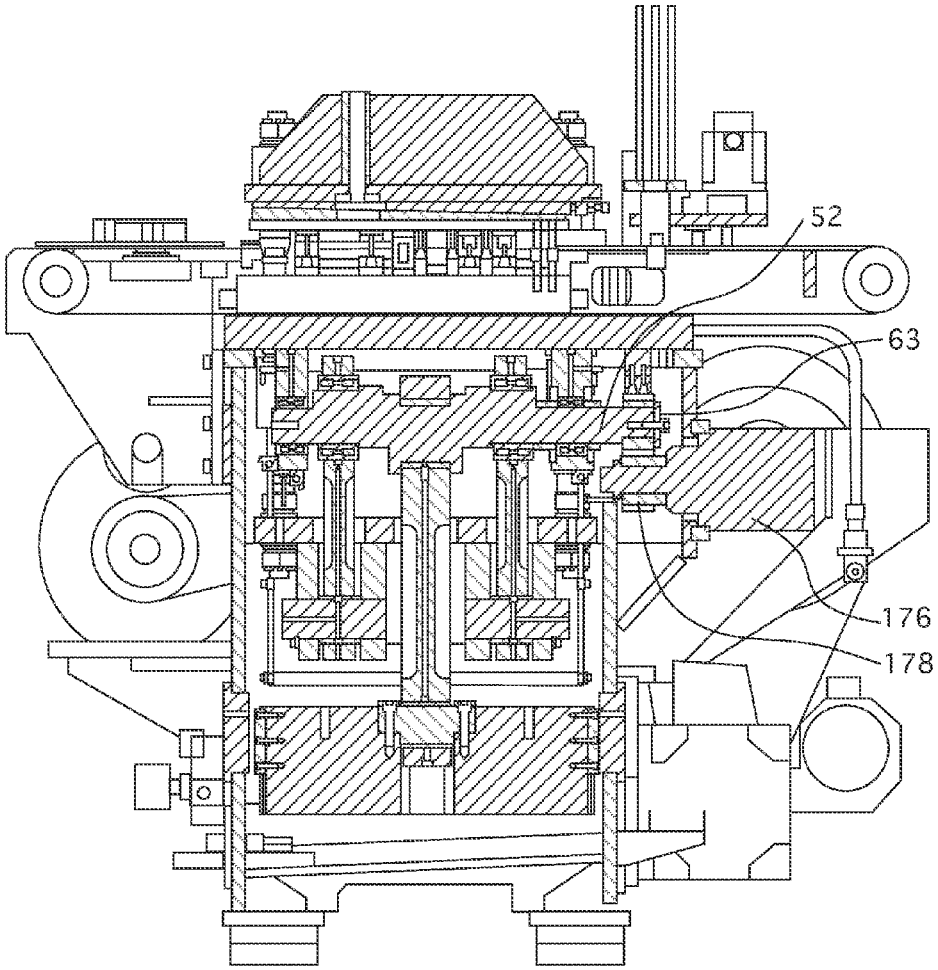
FIG. 6 is a lateral cross-sectional view of a can end conversion system.
Figure 7:
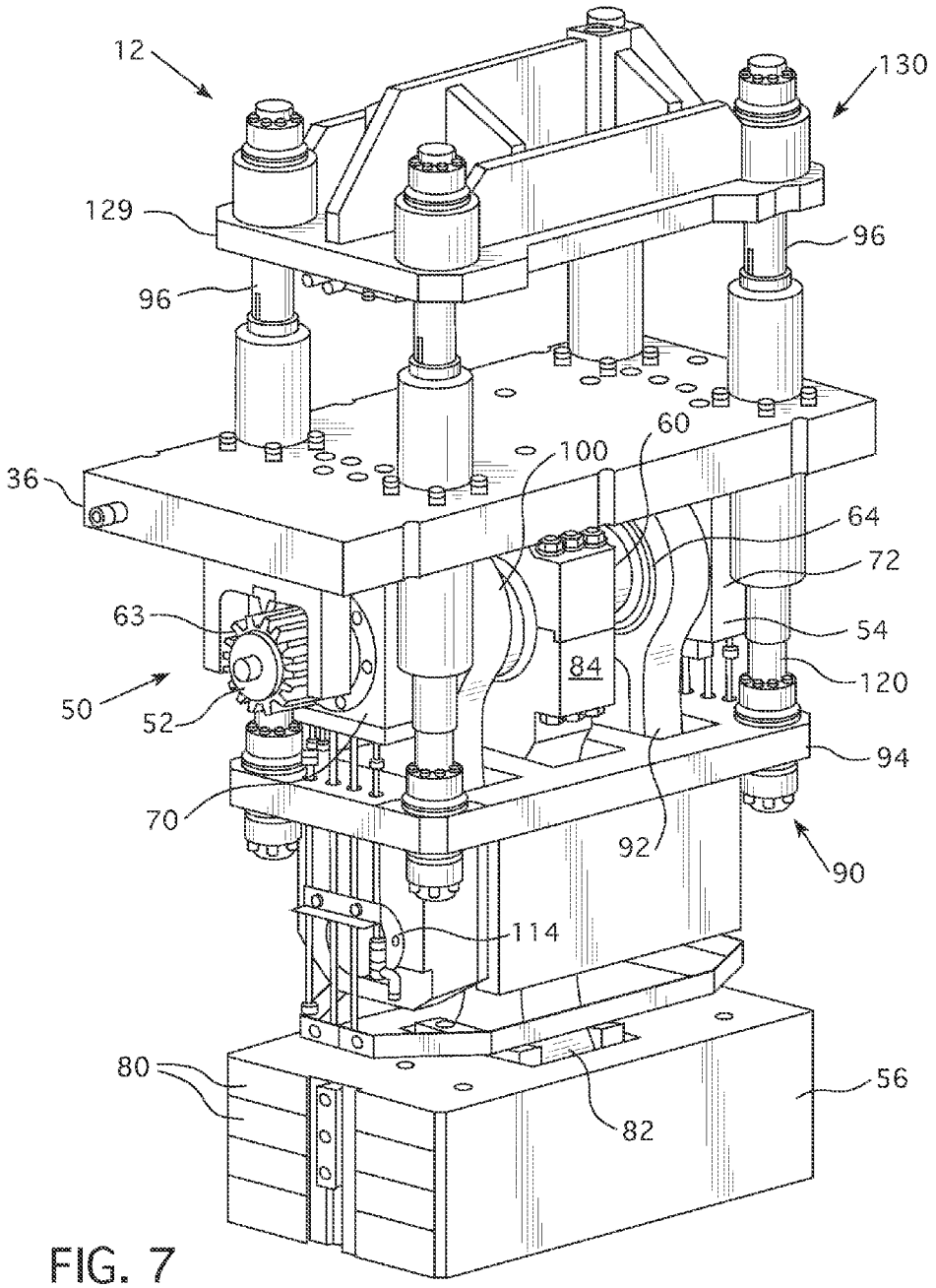
FIG. 7 is a partial isometric view of an end press unit with selected tooling components removed for clarity.

Each gearbox 172 further includes a press shaft 176 and a pinion gear 178, as shown in FIG. 4. Each press shaft 176 extends generally horizontally and about ninety degrees to the axis of rotation of the linkage shafts 170. Within each gearbox 172 is a conversion linkage (not shown) that converts the rotational motion of the linkage shafts 170 to a rotational motion in each press shaft 176. That is, in an exemplary embodiment, within each gearbox 172 there are a number of miter gears (not shown) structured to convert the rotational motion of a linkage shafts 170 about one axis of rotation into rotation of the press shaft 176 about a different, and in an exemplary embodiment perpendicular, axis or rotation. Each gearbox pinion gear 178 is coupled, directly coupled or fixed to an associated press shaft 176. As shown in FIG. 6, each gearbox pinion gear 178 operatively engages a crankshaft pinion gear 63, as discussed below. In this configuration, each press unit 12 is easily separated from the direct drive linkage assembly 166. That is, removal of the press unit 12 from the housing assembly also separates the gearbox pinion gear 178 and crankshaft pinion gear 63.

As noted above the press units 12A, 12B, 12C, 12D are generally similar. An end press unit 12A is shown in FIGS. 6-9 and a tab press unit 12D is shown in FIGS. 10-13. Like reference numbers identify similar elements. Each crankshaft assembly 50 includes crankshaft 52, a crankshaft mounting assembly 54 and a counterweight assembly 56. Each crankshaft 52 includes an elongated, generally cylindrical body 60, having an axis of rotation 62 (also identified herein as the crankshaft longitudinal axis 62), a pinion gear 63 at one end, and a number of offset bearings 64. The crankshaft pinion gear 63 is sized to correspond to, i.e. is structured to be operatively coupled to, and is operatively coupled to, a gearbox pinion gear 178. Thus, the rotational motion of the motor 162 is transferred to each crankshaft 52. The offset bearings 64 include a substantially cylindrical surface 66. Thus, the offset bearings 64 each have a center axis. The center axis of the offset bearings 64 is offset from the crankshaft body axis of rotation 62. Further, the offset bearings 64 are offset in substantially the same radial direction. That is, in an exemplary embodiment, the center axis of the offset bearings 64 are substantially aligned (i.e., disposed on the same line). The crankshaft mounting assembly 54 includes two spaced mounting blocks 70, 72. Each crankshaft mounting block 70, 72 defines a substantially circular opening 74. In an exemplary embodiment, a bearing 76 is disposed in each crankshaft mounting block opening 74. Further, in an exemplary embodiment, the crankshaft mounting blocks 70, 72 are coupled, directly coupled, or fixed to the lower side of fixed mounting plate 36.

The crankshaft 52 is rotatably coupled to the crankshaft mounting assembly 54. That is, in an exemplary embodiment, the ends of crankshaft body 60 are disposed in, and are rotatably coupled to crankshaft mounting blocks 70, 72. In the end press units 12A, 12B, 12C, the crankshaft 52 is oriented so that the crankshaft longitudinal axis 62 is substantially parallel with the associated end lane longitudinal axis 22. As noted above, each crankshaft 52, and in an exemplary embodiment each crankshaft pinion gear 63, is operatively coupled to a gearbox pinion gear 178. Further, each press shaft 176 is substantially aligned with, i.e. parallel to, a crankshaft body axis of rotation 62. Thus, the rotational motion of the motor 162 is transferred to each crankshaft 52.

As noted above, the tab press unit 12D includes similar elements to the end press units 12A, 12B, 12C. Further, the tab press unit crankshaft 52D has a longitudinal axis 62D that is substantially parallel to the press units' crankshaft axes of rotation 62A, 62B, 62C. The tab press unit crankshaft longitudinal axis 62D, however, extends generally perpendicular to the tab press lane tab lane longitudinal axis 22D. Further, the tab press unit kiss blocks 138D, 148D, discussed below, are not subjected to loading during forming operations.

Crankshaft counterweight assembly 56 includes a weight 80 and a support member 82. Crankshaft counterweight assembly support member 82 has an upper end 84 and a lower end 86. Support member upper end 84 defines a rotational coupling which, in an exemplary embodiment, is a substantially circular opening. A bearing 88 may be disposed in the opening in support member upper end 84. A medial portion of crankshaft body 60, i.e., not offset bearings 64, is rotatably disposed in support member upper end 84. Support member lower end 86 is coupled, directly coupled, or fixed to weight 80. Weight 80 is disposed above lower sidewall 32 of the housing assembly 30. That is, the weight 80 is suspended by the crankshaft 52 and, as such, the weight 80 biases the crankshaft 52 downwardly. In this configuration, crankshaft 52 is structured to rotate about the crankshaft body axis of rotation 62 with the offset bearings 64 moving in a circular path about the crankshaft body axis of rotation 62.

Linkage assembly 90 provides the mechanical link between the crankshaft 52 and the first tooling assembly 130. Linkage assembly 90 is rotatably coupled to the crankshaft 52 and, more specifically, to offset bearings 64, and converts the rotational motion of the offset bearings 64 to a reciprocating vertical motion of the first tooling assembly 130. Linkage assembly 90 includes a number of drive rods 92, a mounting platform 94, and a number of guide pins 96. In an exemplary embodiment, there is one drive rod 92 for each offset bearing 64 (two as shown). Each drive rod 92 has a first end 100 and a second end 102. Each drive rod end 100,102 defines a substantially circular opening. Bearings 64 may be disposed in the openings in the drive rod ends 100,102. Each drive rod first end 100 is rotatably coupled to an offset bearing 64. The drive rod second ends 102 are discussed below.

Linkage assembly mounting platform 94 includes a planar member 110 and a number of mounting blocks 112. In an exemplary embodiment, linkage assembly mounting platform planar member 110 is a rectangular planar member 110. As shown, there is one linkage assembly mounting block 112 per drive rod 92. Each linkage assembly mounting block 112 is coupled, directly coupled, or fixed to one planar side (the lower side as shown) of linkage assembly mounting platform planar member 110. Each linkage assembly mounting block 112 includes an axle 114. Each linkage assembly axle 114 is rotatably coupled to a drive rod second end 102. That is, each axle 114 extends through a drive rod second end 102. Linkage assembly mounting platform 94 may include additional members to add weight. That is, linkage assembly mounting platform 94 also acts as a counter balance.

In the configuration described so far, rotation of the crankshaft 52 about the crankshaft body axis of rotation 62 causes the offset bearings 64 to move in a circular path about the crankshaft body axis of rotation 62. This motion imparts a generally vertical motion to the drive rods 92. It is understood that each drive rod first end follows the circular path about the crankshaft body axis of rotation 62 of the offset bearing 64 to which it is attached, but the overall motion of the drive rods 92 is generally a reciprocating vertical motion. Accordingly, age assembly mounting platform 94 reciprocates between an upper position and a lower position.

Guide pins 96 each have an elongated body 120 with a first end 122 and a second end 124. In an exemplary embodiment, there are four guide pins 96. Each guide pin 96 and, more specifically, each guide pin first end 122, is coupled, directly coupled, or fixed to the upper side of linkage assembly mounting platform planar member 110. In an exemplary embodiment, the guide pins 96 are disposed in a rectangular pattern. The guide pins 96 extend substantially vertically. As shown, guide pins 96 pass through fixed mounting plate 36. As such, fixed mounting plate 36, in an exemplary embodiment, includes a guide pin passage 37 for each guide pin 96. Further, each guide pin passage 37 may include a guide sleeve 35 and a guide sleeve bearing 33. In this configuration, guide pins 96 reciprocate with mounting platform 94.

The first and second tooling assemblies 130, 140 operate together to form the can end 1 and couple a tab 2 thereto. The first tooling assembly 130 includes a generally planar support member 129, an elongated first lane die 131 and a first die shoe 132. The first tooling assembly support member 129 is oriented generally horizontally and generally parallel to the associated mounting plate 36. The first lane die 131 includes a number of first tooling components 134. The second tooling assembly 140 includes an elongated second lane die 141 and a second die shoe 142. The second lane die 141 includes a number of second tooling components 144. The first and second lane dies 131, 141 are disposed opposite each other and facing each other. That is, the first lane die shoe 132 is coupled, directly coupled, or fixed to the inner (lower) face of the first tooling assembly support member 129. The first lane die 131 is coupled, directly coupled, or fixed to the first lane die shoe 132. Similarly, the second lane die shoe 142 is coupled, directly coupled, or fixed to the inner (upper) face of the mounting plate 36. The second lane die 141 is coupled, directly coupled, or fixed to the second lane die shoe 142. As used herein, the "inner" face of the tooling assembly support member 129 and the mounting plate 36 are the sides that face each other.

As noted above, the first and second lane dies 131, 141 define a lane 20. The first and second tooling assemblies, in another exemplary embodiment, further include a die holder (not shown) and a die bed (not shown). The die bed is, in an exemplary embodiment, a planar member, and, the die holder is a mounting for the lane die 131, 141. The die shoe 132, 142 is disposed between the die bed and lane die 131, 141. In another exemplary embodiment, the first and second tooling assemblies do not include a die shoe 132, 142. This is possible because the die shoe 132, 142 is structured to spread the impact from forming operations over the die bed, thereby reducing wear. As discussed above, the conversion system 10 operates with reduced loads thereby ameliorating the need for a die shoe 132, 142.

It is further noted, that due in part to the reduced loads associated with the press units 12, the first tooling assembly 130 does not include elements typically required for the tooling assemblies of a ram press 200. For example, a ram press 200 tooling assembly utilizes a die set (or die shoe) with ram press guide pins. Such ram press guide pins, typically, have a diameter of about ten inches and add considerable weight to the first tooling assembly 130. The weight of the ram press guide pins adds increased loads and tipping moments to a ram press. Further, the drive for a ram press must provide additional power in order to move the ram press guide pins. Such ram press guide pins are not part of the present first tooling assembly 130. As such, the present first tooling assembly 130 is lighter than the ram press first tooling assembly. This in turn allows other elements of the conversion system 10 to be less robust and therefore lighter as well.

As discussed below, the end press units 12A, 12B, 12C are subjected to loads and tipping moments that are generally symmetrical about the associated crankshaft body axis of rotation 62. The end lane support member 129A, 129B, 129C each include a support structure 190A, 190B, 190C including a number of planar members 192. The planar members are coupled, directly coupled or fixed to the outer face of the tooling assembly support member 129. The planes of the planar members 192 extend generally perpendicular to the plane of the end lane support members 129A, 129B, 129C. Because the load and tipping moments in the end press units 12A, 12B, 12C are disposed in a generally symmetrical pattern about the associated crankshaft body axis of rotation 62, the end press unit support structures 190A, 190B, 190C are also generally symmetrical about the associated crankshaft body axis of rotation 62. That is, as shown, the support structures 190A, 190B, 190C include three planar members 192 disposed with planes generally parallel to the associated crankshaft body axis of rotation 62 and two planar members 192 disposed with planes generally perpendicular to the associated crankshaft body axis of rotation 62.

As discussed below, the tab lane 20D is disposed generally perpendicular to the associated crankshaft body axis of rotation 62. As such, the tab press unit support structure 190D is asymmetrical. That is, the tab press unit support structure 190D also includes a number of planar members 192 with planes that extend generally perpendicular to the plane of the tab lane support member 129D. The tab press unit support structure 190D, however, is disposed in a non-symmetrical pattern.

The tooling components 134, 144 are cooperative. Cooperative tooling components 134, 144, as used herein, mean that the two tooling components 134, 144 operate together to form a work piece. For example, a punch and a die are two cooperative tooling components. Thus, for each first tooling components 134 there is a cooperative second tooling component 144. As such, the tooling components 134, 144 may be identified collectively as a "pair of cooperative tooling components" or a "tool station 150." It will be appreciated that the conversion system 10 may have any known or suitable number and/or configuration of tool stations 150 structured to perform any variety of desired operations such as, for example and without limitation, rivet forming, panel forming, scoring, embossing and/or final staking. Additional non-limiting examples of tool stations (not shown), which could be employed are described, for example, in U.S. Pat. No. 7,270,246.

The first tooling components 134 are coupled, directly coupled, or fixed to the first die shoe 132. The first tooling components 134 are disposed in series, i.e., generally along a linear path. The second tooling components 144 are coupled, directly coupled, or fixed to the second die shoe 142. The second tooling components 144 are disposed in series, i.e., generally along a linear path. The first die shoe 132 is disposed above the second die shoe 142 and structured to move vertically. It is understood that the tooling components 134, 144 of a cooperative pair are disposed opposite each other. Thus, the first tooling assembly 130 moves between a first position, wherein the first tooling assembly 130 is spaced from the second tooling assembly 140, and a second position, wherein the first tooling assembly 130 is adjacent the second tooling assembly 140. In the second position, the first tooling assembly 130 is sufficiently close to the second tooling assembly 140 so that, during the downstroke (i.e., moving from the first position to the second position) the pair of cooperative tooling components 134, 144 engage the can end shell 1', or tab 2, and perform a forming operation thereon. It is understood that forming operations may be said to occur when the first tooling assembly 130 is in the second position but actually the forming operations occur just as the first tooling assembly 130 moves into the second position. Further, as noted above, the paths over which the pairs of cooperative tooling components 134, 144 are disposed define a lane 20. Thus, the cooperative tooling components 134, 144 are disposed in series within a lane 20. Further, in an exemplary embodiment, the first tooling assembly 130 and, more specifically, the first die shoe 132, has a generally rectangular cross-section in a horizontal plane.

The guide pins 96 extend between linkage assembly mounting platform planar member 110 and the first die shoe 132. Thus, each guide pin 96 is coupled, directly coupled, or fixed to the mounting platform 94 and to the first tooling assembly 130. The second die shoe 142 is coupled, directly coupled, or fixed to the upper side of the fixed mounting plate 36. In this configuration, second tooling assembly 140 is substantially stationary relative to crankshaft 52 and first tooling assembly 130 moves substantially vertically relative to crankshaft 52. That is, as described above, the motion of the drive rods 92 imparts a reciprocal, vertical motion to the mounting platform 94. The motion of mounting platform 94 imparts a vertical motion to the first tooling assembly 130 via the guide pins 96. Stated alternately, in this configuration, the first tooling assembly 130 is movably coupled to the housing assembly 30 and the second tooling assembly 140 is coupled to the housing assembly 30. Each time the first tooling assembly 130 reciprocates, the press unit 12 completes one cycle.

Further, in this configuration, the multiple press drive assembly 160 and the direct drive linkage assembly 166 are operatively coupled to each other. Further, drive linkage assembly 166 is operatively coupled to each press units' crankshaft 52. Within each press unit 12A, 12B, 12C, 12D the following elements are all operatively coupled to each other; the crankshaft 52, the linkage assembly 90, and the first tooling assembly 130. Thus, the motion of the multiple press drive assembly 160 is transferred to each first tooling assembly 130.

As noted above, the first tooling assembly 130 has a generally rectangular cross-section and the guide pins 96, in an exemplary embodiment, are disposed in a rectangular pattern. As noted above, the crankshaft 52 is oriented so that the crankshaft longitudinal axis 62 is substantially parallel with the associated lane longitudinal axis 22. In this configuration, the loads acting upon the first tooling assembly 130 have fewer tipping moments than a press that utilizes a single ram for multiple lanes. This configuration further reduces the deflection of the elements of the linkage assembly 90.

As noted above the four press units 12A, 12B, 12C, 12D are substantially similar with a notable exception being the direction of the tab lane 20D and the lack of loading on the tab press kiss blocks 138D, 148D (discussed below). That is, the three end lanes 20A, 20B, 20C are generally aligned with the crankshaft body axis of rotation 62 and, in an exemplary embodiment, the end lane longitudinal axes 22A, 22B, 22C are disposed above and substantially aligned with the associated crankshaft body axis of rotation 62. The tab lane longitudinal axis 22D extends generally perpendicular to the end lane longitudinal axes 22A, 22B, 22C. This also means that the tab lane longitudinal axis 22D extends generally perpendicular to the associated crankshaft body axis of rotation 62. Further, this means that the tab press first and second tooling assemblies 130, 140, as well as the first and second die lane dies 131, 141, define a tab lane 20 that extends generally perpendicular to the associated crankshaft body axis of rotation 62. To accommodate for the additional forces and tipping moments generated by the different orientation, the tab lane support member 129D is asymmetrical as described above.

As noted above, each lane die 132, 141 is a progressive die which, in an exemplary embodiment, includes eight tool stations 150. For each cycle of the press the shell 1' is moved by feeder device 21 to one tool station 150 and then the next tool station 150. The work being done in each station differs therefore the load of each station is different. In an exemplary embodiment, the first three tool stations 150 form a rivet and create nearly half of load in the lane die 131, 141. Each tool station load can range from as high as about 10,000 lbs. to as low as about 100 lbs.

In an exemplary embodiment, at least one of the end press units first and second tooling assemblies 130A, 130B, 130C, 140A, 140B, 140C further include a number of kiss blocks, shown as first and second kiss blocks 138A, 138B, 138C, 148A, 148B, 148C that are subjected to loads during forming operations, as well as a pre-load. In an exemplary embodiment, there is one kiss block 130A, 130B, 130C, 140A, 140B, 140C disposed between each die shoe 132A, 132B, 132C, 142A, 142B, 142C and each tooling component 134A, 134B, 134C, 144A, 144B, 144C. In the disclosed configuration, i.e., with a crankshaft 52 driving the tooling components 134A, 134B, 134C, 144A, 144B, 144C associated with an end lane 20A, 20B, 20C the kiss blocks 138A, 1389, 138C, 148A, 148B, 148C are deflected by about 0.002 inch. Thus, the reactive force that the kiss blocks 138A, 138B, 138C, 148A, 148B, 148C generate is substantially less than the reactive force required with a system utilizing a press ram. For the conversion system 10, as opposed to a conversion press, the first and second kiss blocks 138A, 138B, 138C, 148A, 148B, 148C are structured to be deflected between about 0.001 and 0.004 inch, or in an exemplary embodiment, about 0.002 inch during the reciprocal motion of the first tooling assembly 130A, 1309, 130C. It is again noted that the tab lane kiss blocks 138D, 148D are not subjected to the loads in the same manner as the end lane kiss blocks 138A, 138B, 138C, 148A, 148B, 148C.

Further, the relative position of the crankshafts 52A, 52B, 52C, 52D operatively coupled to a multiple press drive assembly 160 are, in an exemplary embodiment, different. That is, the orientation of the crankshafts 52A, 529, 52C, 52D are offset from each other so that only one press unit is engaged in forming operations at a specific point in time. A conversion system 10 having such offset crankshafts 52 is, as used herein, structured to independently and sequentially load the first and second tooling assemblies 130, 140. That is, the first tooling assembly 130 of only one press unit 12 are in a second position at one time. In this configuration, the multiple press drive assembly motor 162 is a smaller motor than in a press ram 200, discussed below. Moreover, the multiple press drive assembly motor 162 for a multiple-out conversion system 10, including a 3-out conversion system 10, can be structured to provide a maximum load of between about 5 and 25 tons, or about 15 tons. That is, the load applied by each crankshaft 52 as the first tooling assembly 130 moves into the second position is between about 5 tons and 25 tons, or about 15 tons per module. Thus, in this embodiment and with a 3-out conversion system 10, the multiple press drive assembly motor 162 provides a load of about 60 tons. In another embodiment, the crankshafts 52A, 52B, 52C, 52D are substantially in the same orientation and all first tooling assemblies 130A, 130B, 130C, 130D move in substantially in synch with each other.

In an exemplary embodiment, the relative position of the crankshafts 52A, 52B, 52C, 52D are sequentially offset. For example, a crankshaft 52 is in a first position when the offset bearings 64 are at a topmost, or 12:00 (twelve o'clock) position. It is noted that the position descriptions using "o'clock" positions are broadly representative of the relative offset between crankshafts and are not limiting. The crankshafts 52A, 52B, 52C, 52D rotate from the first position to a second position when the offset bearings 64 (discussed below) are at a bottommost, or 6:00 (six o'clock) position. It is noted that these offsets are not shown in FIG. 5.

In an exemplary embodiment, when the first press unit crankshaft 52A, is in the first position (12:00 o'clock position), the second press unit crankshaft 52B is positioned just behind the first position, e.g. at 11:00 o'clock. "Behind" being relative to the direction the crankshafts 52 are moving. Stated alternately, the orientation of the second press unit crankshaft 52B is offset from the orientation of the first press unit crankshaft 52A. It is understood that "orientation" of a crankshaft 52 relates to the orientation about the crankshaft axis of rotation 62 and not the orientation of the crankshaft 52 relative to some other point, line or plane. In an exemplary embodiment, the second press unit crankshaft 52B is offset between about 1 and 44 degrees, or, between about 2 and 30 degrees, or, between about 5 and 20 degrees, or about 10 degrees "behind" the first press unit crankshaft 52A. That is, the second press unit crankshaft 52B is offset in a direction behind the position of the first press unit crankshaft. The third press unit crankshaft 52C is offset in a similar manner from the second press unit crankshaft 52B, e.g. at the 10:00 o'clock position and the fourth press unit crankshaft 52D is offset in a similar manner from the third press unit crankshaft 52C, e.g. at 9:00 o'clock position. In this configuration, the second press unit crankshaft 52B moves into the first position as the first press unit crankshaft 52A moves out of the first position and toward the second position. Subsequently, the third press unit crankshaft 52C moves into the first position as the second press unit crankshaft 52B moves out of the first position toward the second position, and so forth.

Further, in an exemplary embodiment, as the fourth press unit crankshaft 52D moves past the second (6:00 o'clock) position, none of the crankshafts 52A, 52B, 52C, 52D are in, or moving toward the second position, thus the feeder device 21 may advance the can shells 1' without interference from the tooling assemblies 130, 140, described below. In another exemplary embodiment, the first press unit crankshaft 52A is moving toward the second position when the fourth press unit crankshaft 52D moves just past the second (6:00 o'clock) position.

As the crankshafts 52A, 52B, 52C, 52D rotate, the associated first tooling assemblies 130A, 130B, 130C, 130D reciprocate vertically between a first position, wherein the first tooling assembly 130 is spaced from the second tooling assembly 140, and a second position, wherein the first tooling assembly 130 is adjacent the second tooling assembly 140. Thus, when the orientation of the crankshafts 52A, 52B, 52C, 52D are offset relative to each other, each press unit's first tooling assembly 130 movement is slightly offset in time from the other press units 12. For example, in this configuration, only one press unit 12 is in the second position at one time, or, stated alternately, no two press unit first tooling assemblies 130 are in the second position at the same time.

Forming operations occur when a first tooling assembly 130 moves into the second position. Thus, reactive forces act upon the press units 12 when a first tooling assembly 130 moves into the second position. Accordingly, when the press units 12 sequentially and independently move their first tooling assembly 130 into the second position, the conversion system 10 is exposed to individual, sequential instances of loading and reactive forces. Thus, unlike a conversion press that utilizes a single ram, which must overcome the reactive forces generated by multiple lanes 20 at one time, the conversion system 10 divides the reactive forces over time. Accordingly, the multiple press drive assembly 160 is not required to generate the same force as a ram press 200, discussed below.

Accordingly, in the exemplary configuration, the multiple press drive assembly 160 as well as each press unit 12A, 12B, 12C, 12D and the elements thereof are subjected to reduced loads, tipping moments, kiss block deflections, and stresses. This in turn allows the various elements to be smaller and lighter than press units wherein a ram actuates multiple dies at the same time. That is, the majority of "operational characteristics" of the multiple press drive assembly 160 as well as each press unit 12A, 12B, 12C, 12D are reduced relative to known conversion systems. As used herein, the "operational characteristics" include the weight and physical characteristics (e.g. length, height, width, cross-sectional area, volume, etc.) of the elements, as well as, the loads, deflection, tipping moments, and stresses, applied thereto. Further, "reduced operational characteristics" means that the majority of operational characteristics are smaller, lighter, or "less than" the operational characteristics of, or experienced by, a traditional ram press 200. Because the various elements have reduced operational characteristics, the conversion system 10 itself has reduced operational characteristics.

It is noted that, in one embodiment, the reduced operational characteristics of the conversion system 10 and the various elements are significant features of the disclosed concept which solve selected problems stated above. It is, however, noted that aspects of the disclosed concept may be used in other embodiments and, as such, unless a claim recites operational characteristics, then the operational characteristics are not a significant feature of the disclosed concept.

For example, in an exemplary embodiment, the multiple press drive assembly 160 provides between about 70 tons (140,000 lbs.) and 80 tons (160,000 lbs.) of force or about 75 tons (150,000 lbs.) of force. In another exemplary embodiment, the multiple press drive assembly 160 provides between about 50 tons (100,000 lbs.) and 69 tons (138,000 lbs.) of force or about 60 tons (120,000 lbs.) of force. Thus, this operational characteristic of the multiple press drive assembly 160, i.e. the load provided, is reduced relative to a ram press 200 which, as noted above, typically provides a load of about 250,000 lbs.

Further, in this configuration, the elements of the linkage assembly 90 are subjected to lower loads and may be made from smaller components. For example, guide pins 96 have a diameter between about 1.0 to 5.0 inches, or between about 2.0 and 3.0 inches, or about 2.5 inches compared to the 10.5 inch diameter of a ram press guide pins, discussed above.

Figure 15A:
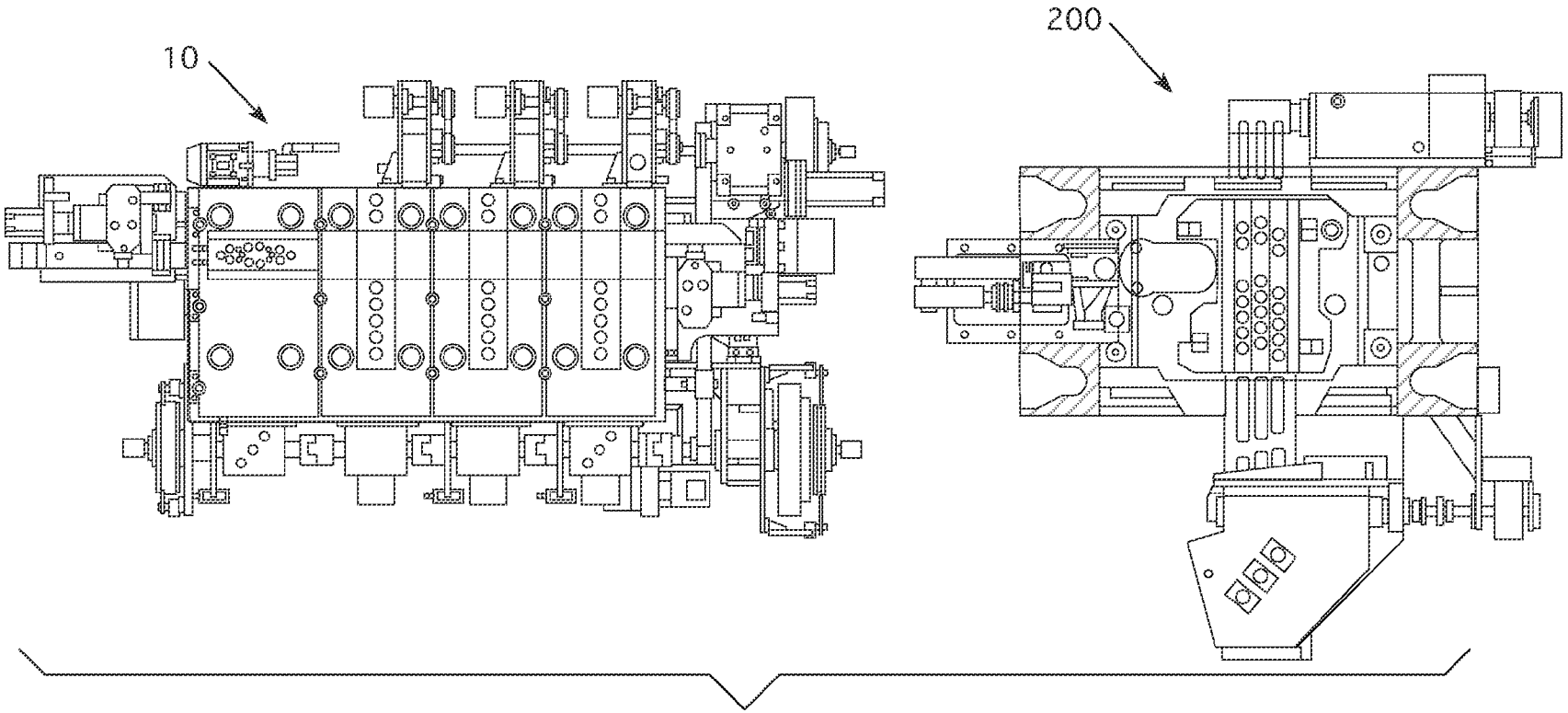
FIGS. 15A-15C show a conversion system relative to a prior art ram press.
Figure 15B:
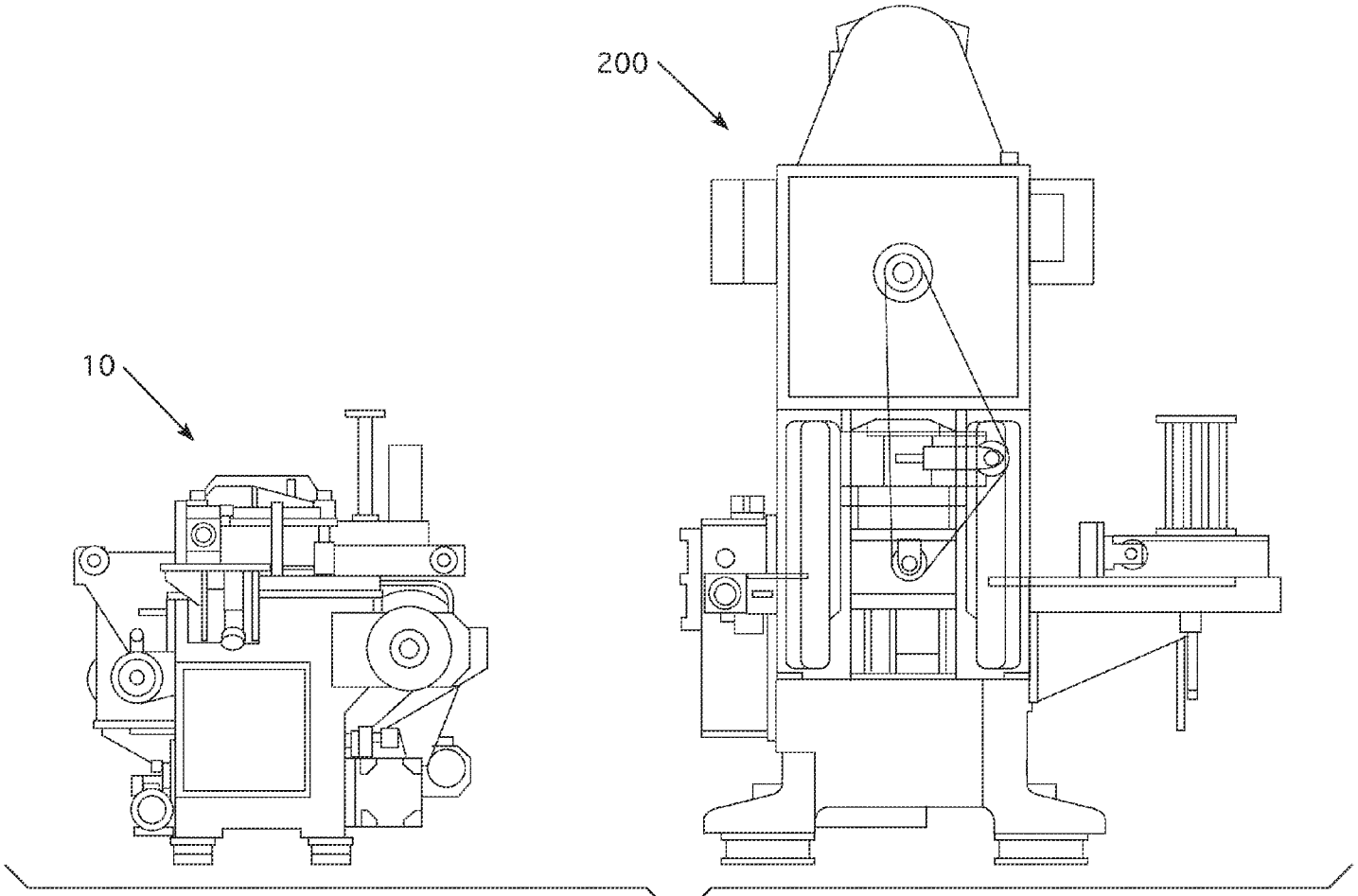
Figure 15C:
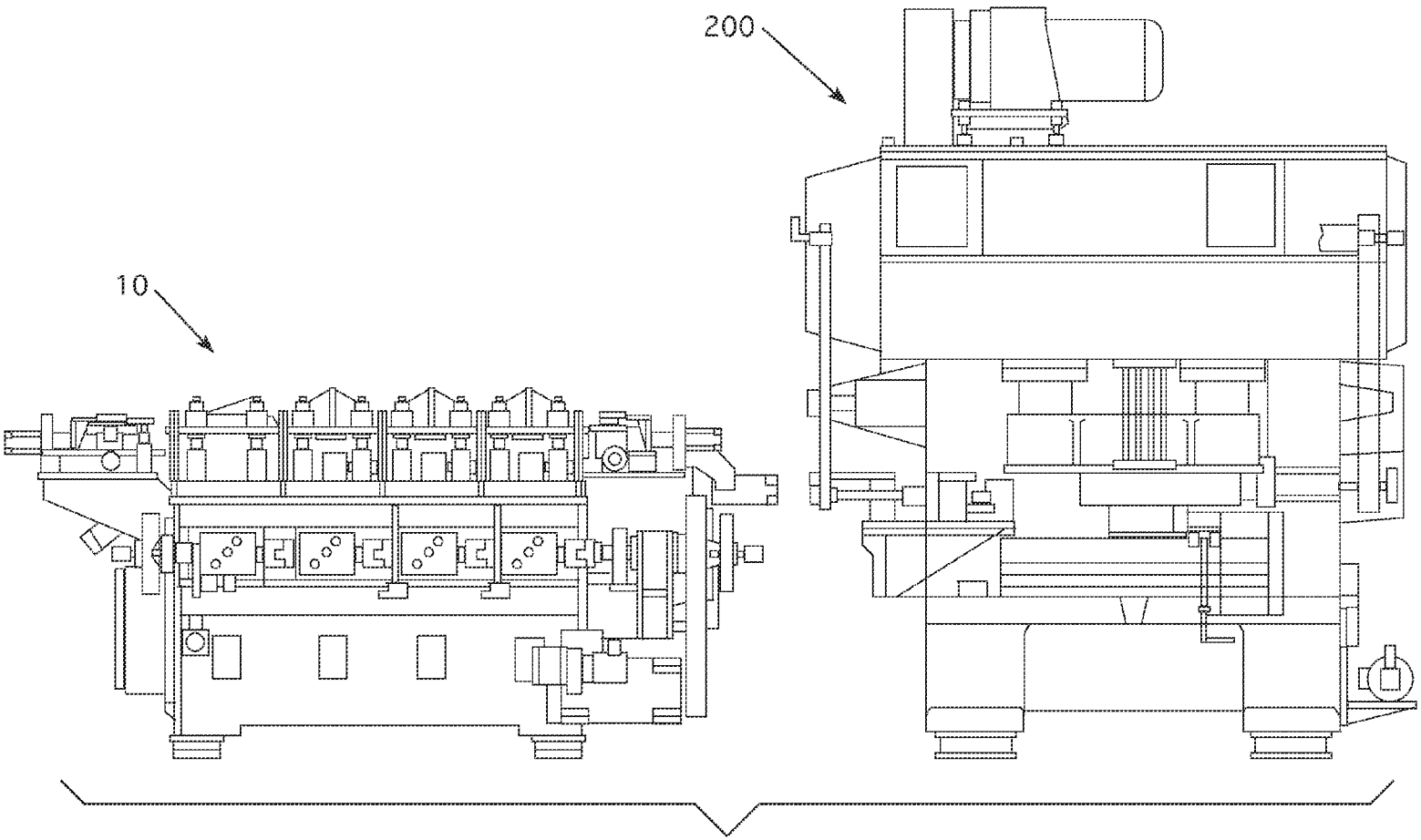

When the can end conversion system 10 is configured as described above, the drive assembly 160 and crankshaft assembly 50 are disposed below the first and second tooling assemblies 130, 140. In this configuration, the drive assembly 160 and crankshaft assembly 50 cannot drip lubricants or other liquids into the lanes 20 and contaminate the can end shell 1' being formed. Moreover, in the disclosed configuration, the conversion system 10 is substantially smaller than a ram press. As shown in FIGS. 15A-15C, an exemplary 3-out conversion system 10 is compared to a 3-out ram press 200 (relevant dimensions, of the exemplary embodiment, are shown on FIGS. 15A-15C). As shown, the conversion system 10 has a volume that is about 50% the volume of a ram press 200, and a height that is about 50% the height of a ram press 200. More specifically, and as shown in FIGS. 15A-15C, the conversion system 10, or 10', elements inclusive in the phrase "the housing assembly 30 and number of press units 12A, 12B, 12C, 12D") has height of between about 60 inches and 100 inches, or about 81.0 inches, a length of between about 120 inches and 160 inches, or about 144.0 inches, and a width of between about 60 inches and 90 inches, or about 74.1 inches. Thus, the volume of the conversion system 10, the housing assembly 30 and number of press units 12A, 12B, 12C, 12D, is between about 200 $ft.^3$ and 800 $ft.^3$, or about 500 $ft.^3$ These operational characteristics of the conversion system 10 are reduced relative to a ram press 200 which typically has a length of about 120.0 inches, a height of about 154.6 inches, a width of about 108.1 inches and a volume of about 1,160.5 $ft.^3$.

Figure 16:
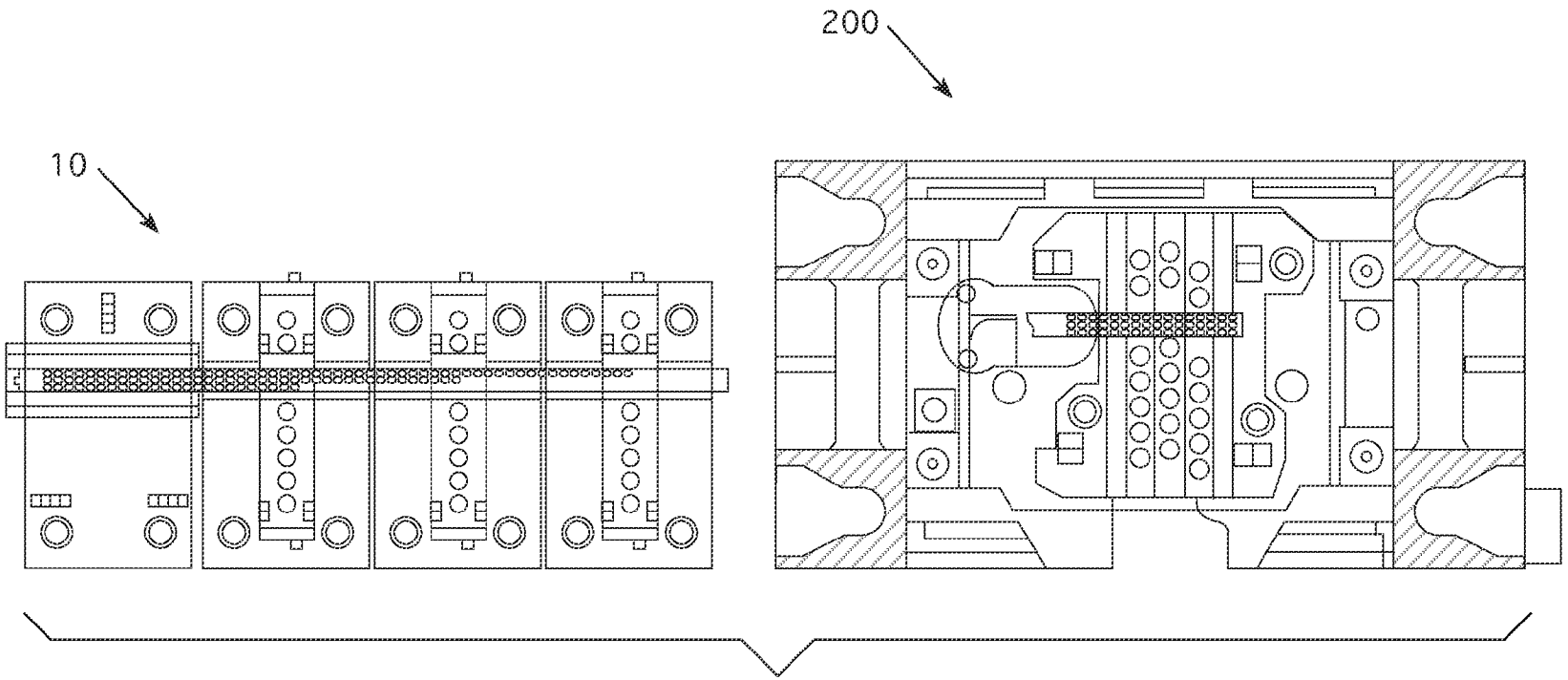
FIG. 16 is a comparison of a conversion system relative to a prior art ram press.
Figure 17:
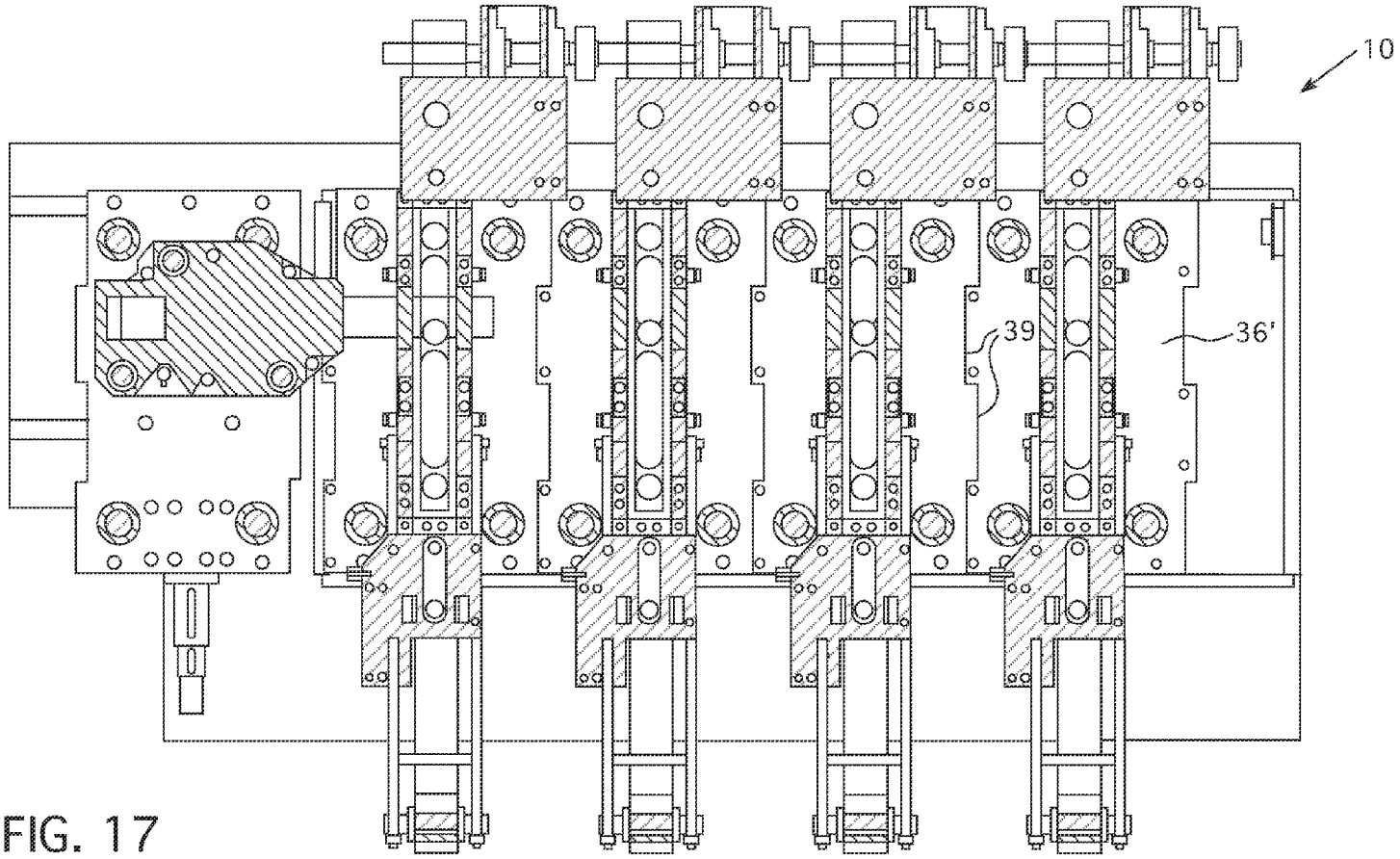
FIG. 17 is a top view of an alternate embodiment of the conversion press.

It is further noted that the mounting plate 36 dimension generally perpendicular to the associated lane 20 determines how close the various end lanes 20A, 20B, 20C are disposed to each other. In another exemplary embodiment, the size of each press unit 12 is further reduced by providing mounting plates 36' with staggered edges. That is, as show in FIG. 16, which shows a 4-out conversion press 10, the mounting plates 36' edges are not substantially straight. Rather, the mounting plates 36' include offsets 39 structured to allow the mounting plates 36' to nest and position the end lanes 20A, 20B, 20C closer to each other.

Further the lane dies of the conversion system 10 weigh about 50% less than the 1,100 lbs. lane die (not shown) of the ram press 200. That is, the conversion system 10 first lane dies 131 have a total weight of between about 450 and 550 lbs., or, about 480 lbs. In alternate terminology, because of the reduction in loads, the conversion system 10 utilizes first lane dies 131 that weigh about 50% less than the first lane dies of a ram press 200. For example, a ram press 200 is structured to move a die having a maximum weight of about 1150 lbs. and upper dies generally have a weight near the maximum allowable weight. A single first lane die 131 of the conversion system 10 weighs between about 80 lbs. and 160 lbs., or between about 100 lbs. and 140 lbs., or about 120 lbs. Thus, a 3-out conversion system 10, with a tab lane 20D, has first lane dies 131 that collectively weigh between about 320 lbs. and 640 lbs., or between about 400 lbs. and 560 lbs., or about 480 lbs. (4× first lane die weight.) total. Stated alternately, the collective weight of the first lane dies 131 is between about 320 lbs. and 640 lbs., or between about 400 lbs. and 560 lbs., or about 480 lbs. It is understood that the collective die weight depends upon the number of lanes 20 and that a four-out conversion press would have a greater weight (generally 5× first lane die weight) This is the mass that is moved by the multiple press drive assembly 160 and which causes much of the tipping moments. Further, the second lane dies 141 have a substantially similar weight.

In a conversion system 10 using modular press units 12, the tooling load is about 15 tons per module. This, in an exemplary 3-out conversion system 10 using modular press units 12, the tooling load, and the load the motor is structured to provide, is about 60 tons (120,000 lbs.). Further, because of the reduced loads, the interference of the end lane kiss blocks 138A, 138B, 138C, 148A, 148B, 148C is about 80% less than the interference experienced by kiss blocks of a ram press 200. That is, the kiss blocks of a ram press 200 have a kiss block deflection of between about 0.009 and 0.011, or about 0.010 inch while a conversion system 10 has a kiss block deflection of between about 0.001 and 0.004, or about 0.002 inch in each press unit 12. As noted above, the less deflection in the end lane kiss blocks 138A, 138B, 138C, 148A, 148B, 148C the less the "snap through," That is, with the reduction in the deflection, there is reduction in vibration and, therefore, a reduction in wear and tear. Thus, these operational characteristics of the end lane kiss blocks 138A, 138B, 138C, 148A, 148B, 148C are reduced relative to a ram press 200.

As shown in FIG. 8, in an exemplary embodiment, the kiss block pre-load is applied by a wedge assembly 500. As shown, the wedge assembly 500 includes two wedge members 502, 504. The wedge members 502, 504, in an exemplary embodiment, include bodies that have a cross-sectional area generally equal to the cross-sectional area of the associated first tooling assembly planar support member 129. Further, in an exemplary embodiment, each wedge member 502, 504 has a body 506, 508 having a taper that is substantially similar to the other wedge member 502, 504. At least one wedge member 502, 504 is movably coupled to the first tooling assembly planar support member 129 and disposed between the first tooling assembly planar support member 129 and the first die shoe 132. At least one wedge member 502, 504 includes a selectably adjustable coupling 512 disposed at the thicker end of the wedge member body 506, 508. Each wedge member 502, 504 is movable coupled to the first tooling assembly planar support member 129 by the adjustable coupling 512.

As shown, the wedge members 502, 504 are disposed with the narrow end of one wedge member 502, 504 disposed adjacent the thick end of the other wedge member 502, 504. In this configuration, the adjustable couplings 512 are used to advance or withdraw the wedge members 502, 504 relative to each other. When the wedge members 502, 504 are advanced toward each other, the overall thickness of the wedge assembly 500 increases and increases the deflection of the associated end lane kiss blocks 138A, 138B, 138C, 148A, 148B, 148C when the first tooling assembly 130 is in the second position.

Further, the modular conversion system 10 allows for about an 50% reduction in tipping loads. That is, the tipping loads in a unit 12 are about 50% less than the tipping loads disclosed in appendix A for a ram press 200. As discussed in Appendix A, the tipping loads can be determined based upon the loads at the tooling stations and the location relative to a selected origin.

In an alternate embodiment, not shown, the drive assembly 40 is coupled to a cam shaft (not shown) rather than a crankshaft 52. In this embodiment, the drive rods extend vertically above the cam shaft and are coupled to the second tooling assembly 140. The second tooling assembly 140 is movable coupled to fixed, substantially vertical guide pins (not shown). As the drive rods move over the cam surface, the second tooling assembly 140 is lifted toward the first tooling assembly 130. In a further alternate embodiment, the second tooling components 144 are movably disposed in the second tooling assembly 140 and structured to move independently and substantially vertically. For example, each second tooling component 144 may be disposed on substantially vertical guide pins (not shown). In this embodiment, there is a drive rod (not shown) for each second tooling component 144 and the cams (not shown) acting upon each drive rod is offset from the other cams. In this configuration, each tool station 150 is actuated at a slightly different time (the actuation periods may overlap). Thus, the total force required to rotate the camshaft is reduced when compared to a crankshaft or cam shaft that must actuate all tool stations 150 at once.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A can end conversion system comprising:

a housing assembly including a plurality of conversion press units;

a drive assembly including a motor;

each said press unit including a number of elongated sets or lanes, a number of crankshafts, and a number of associated first tooling assemblies and second tooling assemblies;

said drive assembly motor operatively coupled to each said crankshaft; each said crankshaft operatively coupled to an associated said first tooling assembly; each said first tooling assembly movably coupled to said housing assembly; each said second tooling assembly coupled to said housing assembly;

wherein rotation of each said crankshaft moves an associated said first tooling assembly between a first position, wherein the first tooling assembly is spaced from the associated second tooling assembly, and a second position, wherein the first tooling assembly is adjacent the associated second tooling assembly.

2. The can end conversion system of claim 1 wherein the load applied by each said crankshaft as said first tooling assembly moves into said second position is between about 5 tons and 25 tons.

3. The can end conversion system of claim 2 wherein the load applied by each said crankshaft as said first tooling assembly moves into said second position is about 15 tons.

4. The can end conversion system of claim 1 wherein:

said housing assembly and said number of press units occupy a volume;

said operational volume is between about 200 $ft.^3$ and 800 $ft.^3$.

5. The can end conversion system of claim 4 wherein said volume is about 500 $ft.^3$.

6. The can end conversion system of claim 4 wherein said housing assembly and said number of press units have a height of between about between about 60 inches and 100 inches.

7. The can end conversion system of claim 6 wherein said housing assembly and said number of press units have a height of about 81.0 inches.

8. The can end conversion system of claim 4 wherein said housing assembly and said number of press units have a width of between about between about 60 inches and 90 inches.

9. The can end conversion system of claim 8 wherein said housing assembly and said number of press units have a width of about 74.1 inches.

10. The can end conversion system of claim 1 wherein:

at least one of said first tooling assembly and said second tooling assembly includes a number of kiss blocks;

each said kiss block subjected to a compressive force as said first tooling assembly moves into said second position;

wherein said compressive force causes each said kiss block to deflect; and said kiss block deflection is between about 0.001 and 0.004 inch.

11. The can end conversion system of claim 10 wherein said kiss block deflection is about 0.002 inch.

12. The can end conversion system of claim 1 wherein:

said plurality of press units include three end press units and one tab press unit; and said drive assembly motor provides a load of between about 70 and 80 tons.

13. The can end conversion system of claim 1 wherein:

each crankshaft's orientation is offset from the other crankshafts;

wherein each said press unit moves the associated said first tooling assembly into said second position offset in time from the other press units.

14. The can end conversion system of claim 13 wherein:

said plurality of press units include three end press units and one tab press unit;

wherein no two press unit first tooling assemblies are in the second position at the same time.

15. The can end conversion system of claim 14 wherein each press unit crankshaft's orientation is offset by about 10 degrees from an adjacent press unit crankshaft's orientation.

16. The can end conversion system of claim 14 wherein:

each said first tooling assembly including a first die; and said first dies collectively weighing between about 450 and 550 lbs.

17. The can end conversion system of claim 16 wherein said first dies collectively weighing about 480 lbs.

18. The can end conversion system of claim 13 wherein said drive assembly motor provides a load of about 60 tons.

* * * * *